US011827485B2

(12) United States Patent
Iwata et al.

(10) Patent No.: US 11,827,485 B2
(45) Date of Patent: Nov. 28, 2023

(54) SHEET CONVEYING APPARATUS

(71) Applicants: Toshiyuki Iwata, Tokyo (JP); Tsukasa Kondo, Yamanashi-ken (JP); Tetsuya Kawasaki, Yamanashi-ken (JP); Yuuki Kubota, Yamanashi-ken (JP)

(72) Inventors: Toshiyuki Iwata, Tokyo (JP); Tsukasa Kondo, Yamanashi-ken (JP); Tetsuya Kawasaki, Yamanashi-ken (JP); Yuuki Kubota, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/360,430

(22) Filed: Jun. 28, 2021

(65) Prior Publication Data

US 2021/0403261 A1 Dec. 30, 2021

(30) Foreign Application Priority Data

Jun. 30, 2020 (JP) ..... 2020-112402
Jun. 11, 2021 (JP) ..... 2021-097981

(51) Int. Cl.
*B65H 7/04* (2006.01)
*B65H 5/02* (2006.01)
*B65H 9/10* (2006.01)

(52) U.S. Cl.
CPC ..... *B65H 7/04* (2013.01); *B65H 5/025* (2013.01); *B65H 9/101* (2013.01)

(58) Field of Classification Search
CPC ..... B65H 5/02; B65H 5/021; B65H 5/025; B65H 7/02; B65H 7/04; B65H 7/20; B65H 9/101; B65H 2511/11; B65H 2511/528; B65H 2601/11; B65H 2601/255
See application file for complete search history.

(56) References Cited

U.S. PATENT DOCUMENTS 5,582,087 A * 12/1996 Crowley ..... G03G 15/6564 101/232
6,371,480 B1 * 4/2002 Demmeler ..... B65H 5/025 271/274
2021/0198065 A1 * 7/2021 Kondo ..... B65H 5/062

FOREIGN PATENT DOCUMENTS

JP 2007-217096 A 8/2007

* cited by examiner

*Primary Examiner* — Prasad V Gokhale
(74) *Attorney, Agent, or Firm* — Manabu Kanesaka

(57) ABSTRACT

In order to provide a configuration capable of suppressing reductions in productivity of sheets, a pair of regulation guides are capable of guiding opposite end edges in a sheet width direction Y of a sheet S1 conveyed by a conveyance belt and spheres, while being nipped. Further, the pair of regulation guides are capable of shifting to guide positions for guiding the opposite end edges of the sheet, and retract positions retracted from the opposite end edges of the sheet more than the guide positions. A sheet detecting sensor is disposed on the downstream side relative to the conveyance belt in a conveyance direction X to detect the presence or absence of the sheet.

14 Claims, 11 Drawing Sheets

SHEET CONVEYING APPARATUS

TECHNICAL FIELD

The present invention relates to a sheet conveying apparatus for conveying sheets.

BACKGROUND ART

In a sheet conveying apparatus for conveying sheets, there is the risk that misregistration of a sheet occurs due to various factors during conveyance of the sheet. Then, while the misregistration occurs, for example, in the case of conveying to an image forming apparatus for forming an image on the sheet, the inconvenience occurs such that the image is displaced with respect to the sheet. Therefore, there is a known sheet conveying apparatus for correcting misregistration of a sheet under conveyance (e.g., Japanese Unexamined Patent Publication No. 2007-217096).

In Japanese Unexamined Patent Publication No. 2007-217096 is disclosed a configuration including a fixed reference guide provided on one side in a width direction crossing a sheet conveyance direction, a conveyance belt provided obliquely with respect to the reference guide, and spheres. In the case of the sheet conveying apparatus described in Japanese Unexamined Patent Publication No. 2007-217096, the conveyance belt and spheres convey the sheet, while nipping, and an end edge of the sheet in the width direction is struck by the reference guide. Then, side registration (misregistration of end edges in the sheet width direction) and side skew (skew of the end edge of the sheet in the width direction with respect to the sheet conveyance direction) is concurrently corrected.

DISCLOSURE OF INVENTION

Problems to be Solved by the Invention

In the case of the sheet conveying apparatus described in Japanese Unexamined Patent Publication No. 2007-217096, while the sheet is conveyed by the conveyance belt provided obliquely, the end edge of the sheet in the width direction is struck by the reference guide. Therefore, it is necessary to convey the sheet until the sheet is struck by the reference guide, and in order to reserve a length to convey the sheet, there is the risk that the apparatus is increased in size. Then, in order to correct misregistration of the sheet in the width direction, while suppressing upsizing of the apparatus, such a configuration is considered that a pair of regulation guides are provided on opposite sides of the sheet in the width direction. In the case of this configuration, a pair of regulation guides are shifted from retract positions to guide positions to guide opposite end edges of the sheet in the width direction in the guide positions, and thereby correct misregistration of the sheet in the width direction.

Herein, in the case of the configuration for conveying the sheet by the conveyance belt and the spheres, while nipping, a force is weak in nipping the sheet by the conveyance belt and the spheres. Therefore, when the sheet under conveyance comes into contact with the regulation guide in the guide position, and a friction force is large between the sheet and the regulation guide, there is the risk that the sheet is not conveyed even when the conveyance belt is driven. Then, when a sensor on the downstream side relative to the conveyance belt does not detect the sheet for a predetermined time, since the apparatus determines that the sheet jams and halts, productivity is reduced.

It is an object of the present invention to provide a configuration capable of suppressing reductions in productivity of sheets.

Means for Solving the Problem

In the present invention, a sheet conveying apparatus for conveying a sheet in a predetermined conveyance direction is provided with an endless conveyance belt that includes a conveyance face extended along the conveyance direction to convey the sheet delivered to the conveyance face in the conveyance direction, a plurality of spheres disposed in positions opposed to the conveyance face in the conveyance direction to be rotatable in any direction, while nipping the sheet between the spheres and the conveyance face, a pair of regulation guides disposed on opposite sides of the conveyance belt with respect to a sheet width direction crossing the conveyance direction to be able to guide opposite end edges in the sheet width direction of the sheet conveyed by the conveyance belt and the spheres, while being nipped, a guide shift section capable of shifting the pair of regulation guides to guide positions for guiding the opposite end edges of the sheet in the sheet width direction and retract positions retracted from the opposite end edges of the sheet in the sheet width direction more than the guide positions, and a detecting section disposed on the downstream side relative to the conveyance belt in the conveyance direction to detect the presence or absence of the sheet, where in the case that the detecting section does not detect the sheet after a lapse of a predetermined time since the pair of regulation guides shift from the retraction positions to the guide positions, retract operation is performed where the pair of regulation guides shift from the guide positions to the retract positions in a state of continuing to drive the conveyance belt in a direction for conveying the sheet.

Further, in the present invention, a sheet conveying apparatus for conveying a sheet in a predetermined conveyance direction is provided with an endless conveyance belt that includes a conveyance face extended along the conveyance direction to convey the sheet delivered to the conveyance face in the conveyance direction, a plurality of spheres disposed in positions opposed to the conveyance face in the conveyance direction to be rotatable in any direction, while nipping the sheet between the spheres and the conveyance face, a pair of regulation guides disposed on opposite sides of the conveyance belt with respect to a sheet width direction crossing the conveyance direction to be able to guide opposite end edges in the sheet width direction of the sheet conveyed by the conveyance belt and the spheres, while being nipped, a guide shift section capable of shifting the pair of regulation guides to guide positions for guiding the opposite end edges of the sheet in the sheet width direction and retract positions retracted from the opposite end edges of the sheet in the sheet width direction more than the guide positions, an upstream-side detecting section disposed on the upstream side relative to the conveyance belt in the conveyance direction to detect the presence or absence of the sheet, and a downstream-side detecting section disposed on the downstream side relative to the conveyance belt in the conveyance direction to detect the presence or absence of the sheet, where after a rear end of the sheet passes through the upstream-side detecting section, the guide shift section starts to shift the pair of regulation guides from the retract positions to the guide positions, and in the case that the downstream-side detecting section does not detect the sheet after a lapse of a predetermined passing subsequent time since the rear end of the sheet passes through the upstream-side detecting section, retract operation is performed where the pair of regulation guides shift from the guide positions to the retract positions in a state of continuing to drive the conveyance belt in a direction for conveying the sheet.

Furthermore, in the present invention, a sheet conveying apparatus for conveying a sheet in a predetermined conveyance direction is provided with an endless conveyance belt that includes a conveyance face extended along the conveyance direction to convey the sheet delivered to the conveyance face in the conveyance direction, a plurality of spheres disposed in positions opposed to the conveyance face in the conveyance direction to be rotatable in any direction, while nipping the sheet between the spheres and the conveyance face, a pair of regulation guides disposed on opposite sides of the conveyance belt with respect to a sheet width direction crossing the conveyance direction to be able to guide opposite end edges in the sheet width direction of the sheet conveyed by the conveyance belt and the spheres, while being nipped, a guide shift section capable of shifting the pair of regulation guides to guide positions for guiding the opposite end edges of the sheet in the sheet width direction, and first retract positions or second retraction positions retracted from the opposite end edges of the sheet in the sheet width direction more than the guide positions, and a detecting section disposed on the downstream side relative to the conveyance belt in the conveyance direction to detect the presence or absence of the sheet, where the pair of regulation guides are positioned in the first retract positions before the sheet is delivered to the conveyance belt, and in the case that the detecting section does not detect the sheet after a lapse of a predetermined time since the pair of regulation guides shift from the first retraction positions to the guide positions, retract operation is performed where the pair of regulation guides shift from the guide positions to the second retract positions in a state of continuing to drive the conveyance belt in a direction for conveying the sheet.

Still furthermore, in the present invention, a sheet conveying apparatus for conveying a sheet in a predetermined conveyance direction is provided with an endless conveyance belt that includes a conveyance face extended along the conveyance direction to convey the sheet delivered to the conveyance face in the conveyance direction, a plurality of spheres disposed in positions opposed to the conveyance face in the conveyance direction to be rotatable in any direction, while nipping the sheet between the spheres and the conveyance face, a pair of regulation guides disposed on opposite sides of the conveyance belt with respect to a sheet width direction crossing the conveyance direction to be able to guide opposite end edges in the sheet width direction of the sheet conveyed by the conveyance belt and the spheres, while being nipped, a guide shift section capable of shifting the pair of regulation guides to guide positions for guiding the opposite end edges of the sheet in the sheet width direction and retract positions retracted from the opposite end edges of the sheet in the sheet width direction more than the guide positions, and a detecting section disposed on the downstream side relative to the conveyance belt in the conveyance direction to detect the presence or absence of the sheet, where in the case that the detecting section does not detect the sheet in continuing drive of the conveyance belt in the conveyance direction by a predetermined amount after the pair of regulation guides shift from the retraction positions to the guide positions, retract operation is performed where the pair of regulation guides shift from the guide positions to the retract positions in a state of continuing to drive the conveyance belt in a direction for conveying the sheet.

Moreover, in the present invention, a sheet conveying apparatus which receives and conveys a sheet conveyed by a conveyance member for conveying the sheet in a predetermined conveyance direction is provided with an endless conveyance belt disposed on the downstream side relative to the conveyance member in the conveyance direction to include a conveyance face extended in the conveyance direction and to convey the sheet delivered to the conveyance face in the conveyance direction, a plurality of spheres disposed in positions opposed to the conveyance face in the conveyance direction to be rotatable in any direction, while nipping the sheet between the spheres and the conveyance face, a pair of regulation guides disposed on opposite sides of the conveyance belt with respect to a sheet width direction crossing the conveyance direction to be able to guide opposite end edges in the sheet width direction of the sheet conveyed by the conveyance belt and the spheres, while being nipped, and a guide shift section capable of shifting the pair of regulation guides to guide positions for guiding the opposite end edges of the sheet in the sheet width direction and retract positions retracted from the opposite end edges of the sheet in the sheet width direction more than the guide positions, where the pair of regulation guides are shifted from the retract positions to the guide positions, while conveying the sheet in the conveyance direction using the conveyance belt and the spheres, and after a lapse of a predetermined time since the pair of regulation guides shift to the guide positions, retract operation is performed where the pair of regulation guides shift from the guide positions to the retract positions in a state of continuing to drive the conveyance belt in a direction for conveying the sheet.

Advantageous Effect of the Invention

According to the present invention, it is possible to stably perform conveyance of sheets.

BRIEF DESCRIPTION OF DRAWINGS

FIG. 11A illustrates a state of receiving a sheet, FIG. 11B illustrates a state in which a rear end of the sheet passes through a sheet detecting sensor, FIG. 11C illustrates a state in which the sheet is caught in the regulation guides and is halted, and FIG. 11D illustrates a state in which the regulation guides shift to retract positions.

MODE FOR CARRYING OUT THE INVENTION

An Embodiment will be described with reference to FIGS. 1 to 11D. First, an image forming system of this Embodiment will be described with reference to FIG. 1.

[Image Forming System]

Figure 1:
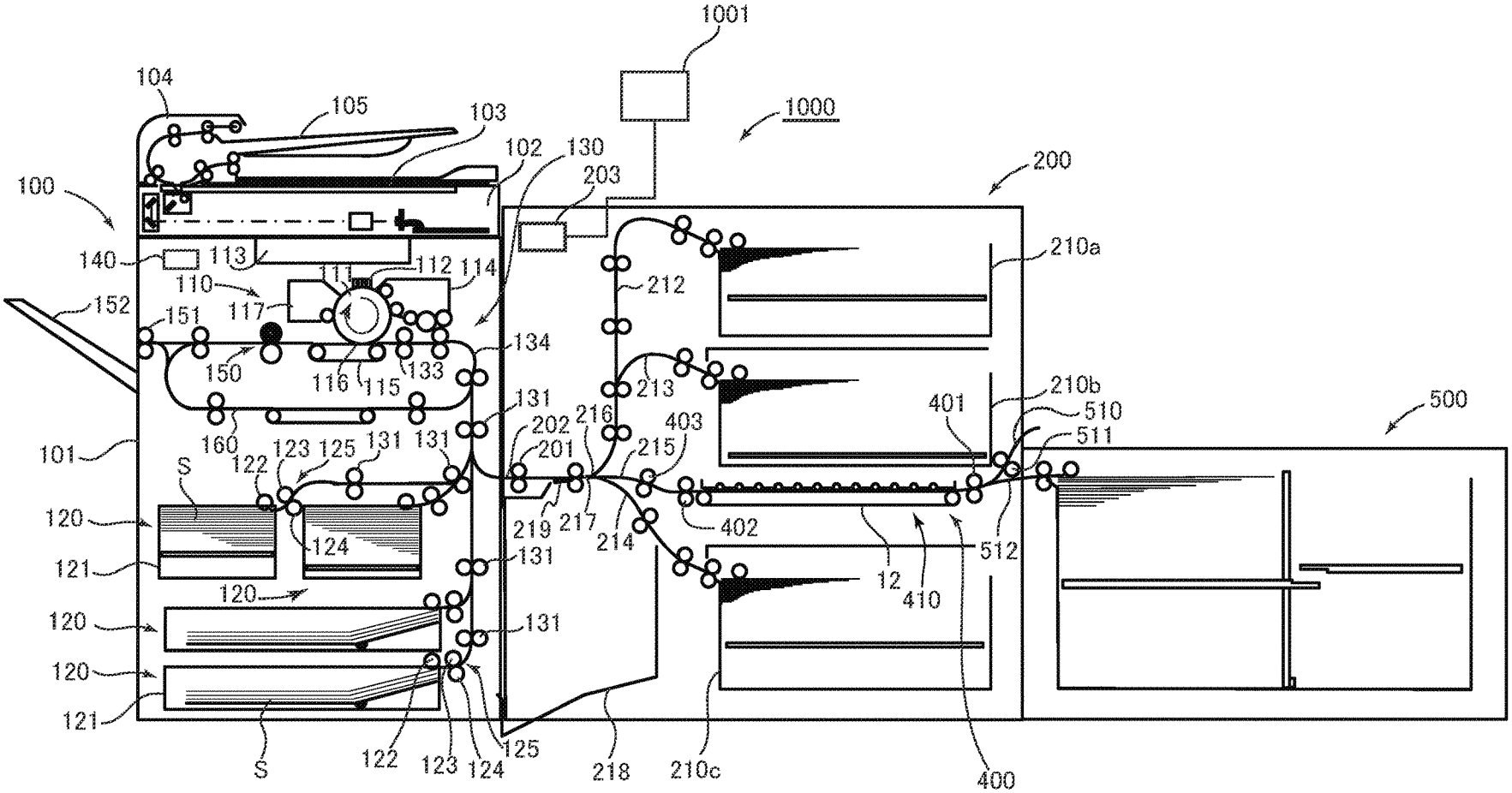
FIG. 1 is a schematic configuration cross-sectional view of an image forming system according to an Embodiment.

FIG. 1 is a cross-sectional view schematically showing one example of an image forming system provided with a multi-stage feed apparatus and image forming apparatus according to this Embodiment. In the following description, as the image forming apparatus including an image forming section, a laser printer system (hereinafter, simply called a printer) using an electrophotographic scheme will be described as an example. In addition, as well as the printer, the image forming apparatus constituting the image forming system may be a copier, facsimile, composite machine and the like. Further, the image forming apparatus is not limited to the electrophotographic scheme, and may be a configuration of another scheme such as an ink jet scheme.

The image forming system 1000 of this Embodiment includes an image forming apparatus 100, a multi-stage feed apparatus 200 connected to the image forming apparatus 100 as a sheet feed apparatus, and a feed deck 500. As described later in detail, the multi-stage feed apparatus 200 includes a plurality of storage chambers each capable of storing a plurality of sheets, and is capable of feeding a sheet from each of the storage chambers to the image forming apparatus 100. Further, the feed deck 500 also includes a storage chamber capable of storing a plurality of sheets, and is disposed on the upstream side relative to the multi-stage feed apparatus 200 with respect to a sheet conveyance direction. Further, the sheet fed from the feed deck 500 is conveyed to the image forming apparatus 100 via a relay conveying apparatus 400 provided in the multi-stage feed apparatus 200. In addition, as sheets, there are papers such as normal paper, thin paper and thick paper, plastic sheets and the like.

The image forming apparatus 100 forms a toner image (image) on a sheet corresponding to an image signal from a document reading apparatus 102 connected to an image forming apparatus main body 101, or a host apparatus such as a personal computer connected to the image forming apparatus main body 101 to be communicable and the like. In the case of this Embodiment, the document reading apparatus 102 is disposed on the image forming apparatus main body 101.

In reading a document, the document reading apparatus 102 irradiates the document placed on platen glass 103 with light by a scanning optical system light source, while inputting reflected light to a CCD, and thereby reads a document image. Further, the document reading apparatus 102 is provided with an automatic document feeder (ADF) 104, and is also able to read a document image by automatically conveying a document placed on a tray 105 to a reading section of the document reading apparatus 102 by the ADF 104. Then, the read document image is converted into an electric signal, and is transmitted to a laser scanner 113 of an image forming section 110 described later. In addition, there is also the case where image data transmitted from the personal computer or the like as described above is input to the laser scanner 113.

The image forming apparatus 100 is provided with the image forming section 110, a plurality of sheet feed apparatuses 120, sheet conveying apparatus 130 and the like. In the image forming apparatus 100, a control section 140 controls each section. The control section 140 has a CPU (Central Processing Unit), ROM (Read Only Memory), and RAM (Random Access Memory). The CPU reads programs that correspond to control procedures stored in the ROM to control each section. Further, in the RAM is stored operation data and input data, and the CPU performs control by referring to the data stored in the RAM, based on the programs and the like described previously.

Each of the plurality of sheet feed apparatuses 120 is provided with a cassette 121 for storing sheets S, a pick-up roller 122, and a separation conveyance roller pair 125 comprised of a feed roller 123 and retard roller 124. The sheets S stored inside the cassette 121 are separated and fed on a sheet-by-sheet basis, by the pick-up roller 122 for performing up-and-down operation and rotating at predetermined timing, and the separation conveyance roller pair 125.

The sheet conveying apparatus 130 is provided with a conveyance roller pair 131, and register roller pair 133. The sheet S fed from the sheet feed apparatus 120 is passed through a sheet conveyance path 134 by the conveyance roller pair 131, and then, is guided to the register roller pair 133. Subsequently, the sheet S is sent to the image forming section 110 at predetermined timing by the register roller pair 133.

In addition, the sheet, which is conveyed from the multi-stage feed apparatus 200 described later and the feed deck 500 via a conveyance roller pair 201, is conveyed into the image forming apparatus 100 via a connection path 202 with the image forming apparatus 100. Then, the sheet, which is conveyed from the multi-stage feed apparatus 200 and the feed deck 500 into the image forming apparatus 100, is sent into the image forming section 110 at predetermined timing via the register roller pair 133, as the sheet conveyed from the sheet feed apparatus 120 inside the image forming apparatus 100.

The image forming section 110 is provided with a photosensitive drum 111, charger 112, laser scanner 113, developing device 114, transfer apparatus 115, cleaner 117 and the like. At the time of image formation, the photosensitive drum 111 is driven to rotate in the arrow direction shown in the figure, and first, a surface of the photosensitive drum 111 is uniformly charged by the charger 112. Then, the charged photosensitive drum 111 is irradiated with laser light from the laser scanner 113 emitted corresponding to the image signal, and an electrostatic latent image is thereby formed on the photosensitive drum 111. Further, the electrostatic latent image thus formed on the photosensitive drum 111 is subsequently developed as a toner image by the developing device 114.

Subsequently, the toner image on the photosensitive drum 111 is transferred to the sheet S by the transfer apparatus 115 in a transfer section 116. Further, the sheet S with the toner image thus transferred is conveyed to a fuser apparatus 150 to fuse the toner image, and then, is discharged to a discharge tray 152 outside the apparatus by a discharge roller 151.

In the case where a toner image is formed on the backside of the sheet S, the sheet S discharged from the fuser apparatus 150 is conveyed to a reverse conveyance path 160. Then, in a state in which the side is reversed by the reverse conveyance path 160, the sheet S is conveyed again to the transfer section 116 of the image forming section 110. The sheet S with the toner image transferred to the backside is conveyed to the fuser apparatus 150, and after fusing the toner image, is discharged to the discharge tray 152 by the discharge roller 151. In addition, after transferring, transfer residual toner left on the photosensitive drum 111 is removed by the cleaner 117.

[Multi-Stage Feed Apparatus]

Successively, the outline of the multi-stage feed apparatus 200 will be described with reference to FIG. 1. The multi-stage feed apparatus 200 is provided with a plurality of storage chambers 210*a* to 210*c*, relay conveying apparatus 400 and the like. In this Embodiment, three storage chambers 210*a* to 210*c* are arranged vertically in three stages, and the relay conveying apparatus 400 is disposed between the lowermost storage chamber 210*c* and the second uppermost storage chamber 210*b*.

A sheet fed from the uppermost storage chamber 210*a* is conveyed to a conveyance path 212, a sheet fed from the second uppermost storage chamber 210*b* is conveyed to a conveyance path 213, and a sheet fed from the lowermost storage chamber 210*c* is conveyed to a conveyance path 214. Further, a sheet conveyed from the relay conveying apparatus 400 is conveyed to a conveyance path 215. The conveyance path 213 merges with the conveyance path 212 at some midpoint. Further, the conveyance paths 212, 214 and 215 merge at a confluence 216, and the sheet is conveyed to the conveyance roller pair 201 through a conveyance path 217, and is conveyed to the image forming apparatus 100 via the connection path 202.

Further, a multi feed detecting sensor for detecting multi feed of sheets is disposed in each of the conveyance path 212 merged with the conveyance path 213, the relay conveying apparatus 400 and the conveyance path 214. Then, sheets with multi feed detected by the multi feed detecting sensor are conveyed to the conveyance path 217. Below the conveyance path 217 is disposed a multi feed sheet storage section (escape tray) 218 for storing sheets with multi feed detected. The sheets with multi feed detected are conveyed to the conveyance path 217, and are conveyed to the multi feed sheet storage section, by switching between conveyance paths by a switch member 219 provided in the conveyance path 217.

Further, in the multi-stage feed apparatus 200, a control section 203 controls each section. The control section 203 has a CPU (Central Processing Unit), ROM (Read Only Memory), and RAM (Random Access Memory). Further, the control section 203 is capable of communicating with the control section 140 of the image forming apparatus 100, and by communicating with the control section 140, controls feed timing of the sheet and the like.

The sheet fed from the feed deck 500 on the upstream side passes through a conveyance path 512, and is conveyed to the relay conveying apparatus 400. Further, the multi-stage feed apparatus 200 enables a sheet manually inserted to be also fed. The manually fed sheet is conveyed to a conveyance path 510 merging with the conveyance path 512, and is conveyed to the relay conveying apparatus 400 via the conveyance path 512 by a conveyance roller pair 511.

Although details will be described next, the relay conveying apparatus 400 is provided with a misregistration correcting section 410 provided with a conveyance belt 12 and the like, a conveyance roller pair 401 on the upstream side relative to the misregistration correcting section 410 in the sheet conveyance direction, a conveyance roller pair 402 on the downstream side relative to the misregistration correcting section 410 in the sheet conveyance direction, and the like. The sheet conveyed in the conveyance path 512 is fed to the misregistration correcting section 410 by the conveyance roller pair 401. After correcting side registration (misregistration of end edges in the sheet width direction) and side skew (skew of the end edge of the sheet in the width direction with respect to the sheet conveyance direction) in the misregistration correcting section 410, the sheet is delivered to the conveyance roller pair 402 on the downstream side. Then, the sheet is conveyed to the conveyance path 215 by the conveyance roller pairs 402, 403. Thus, the relay conveying apparatus 400 corrects misregistration and so on of the sheet conveyed from the feed deck 500 and the like on the upstream side, and delivers to the image forming apparatus 100 on the downstream side.

[Relay Conveying Apparatus]

The relay conveying apparatus 400 as a sheet conveying apparatus will be described next. First, a schematic configuration of the relay conveying apparatus 400 will be described with reference to FIGS. 2 to 5. The relay conveying apparatus 400 includes the conveyance roller pair 401 on the upstream side, the conveyance roller pair 402 on the downstream side, the misregistration correcting section 410 described above and the like, and conveys the sheet in a conveyance direction X. The misregistration correcting section 410 has the conveyance belt 12, a plurality of spheres 20, a pair of regulation guides 14A, 14B, guide shift section 420 and the like.

The conveyance belt 12 is disposed downstream (downstream in the conveyance direction) in the conveyance direction X (predetermined conveyance direction) from the conveyance roller pair 401 as a conveyance member for conveying the sheet. The conveyance belt 12 is an endless belt looped between pulleys 11A, 11B, and has a conveyance face 12A provided to extend along the conveyance direction X. To the pulley 11A on one side is connected a motor M1 as a drive source, and the conveyance belt 12 rotates by drive of the motor M1. Such a conveyance belt 12 conveys, in the conveyance direction X, the sheet delivered from the conveyance roller pair 401 on the upstream side in the conveyance direction X to the conveyance face 12A.

Figure 2:
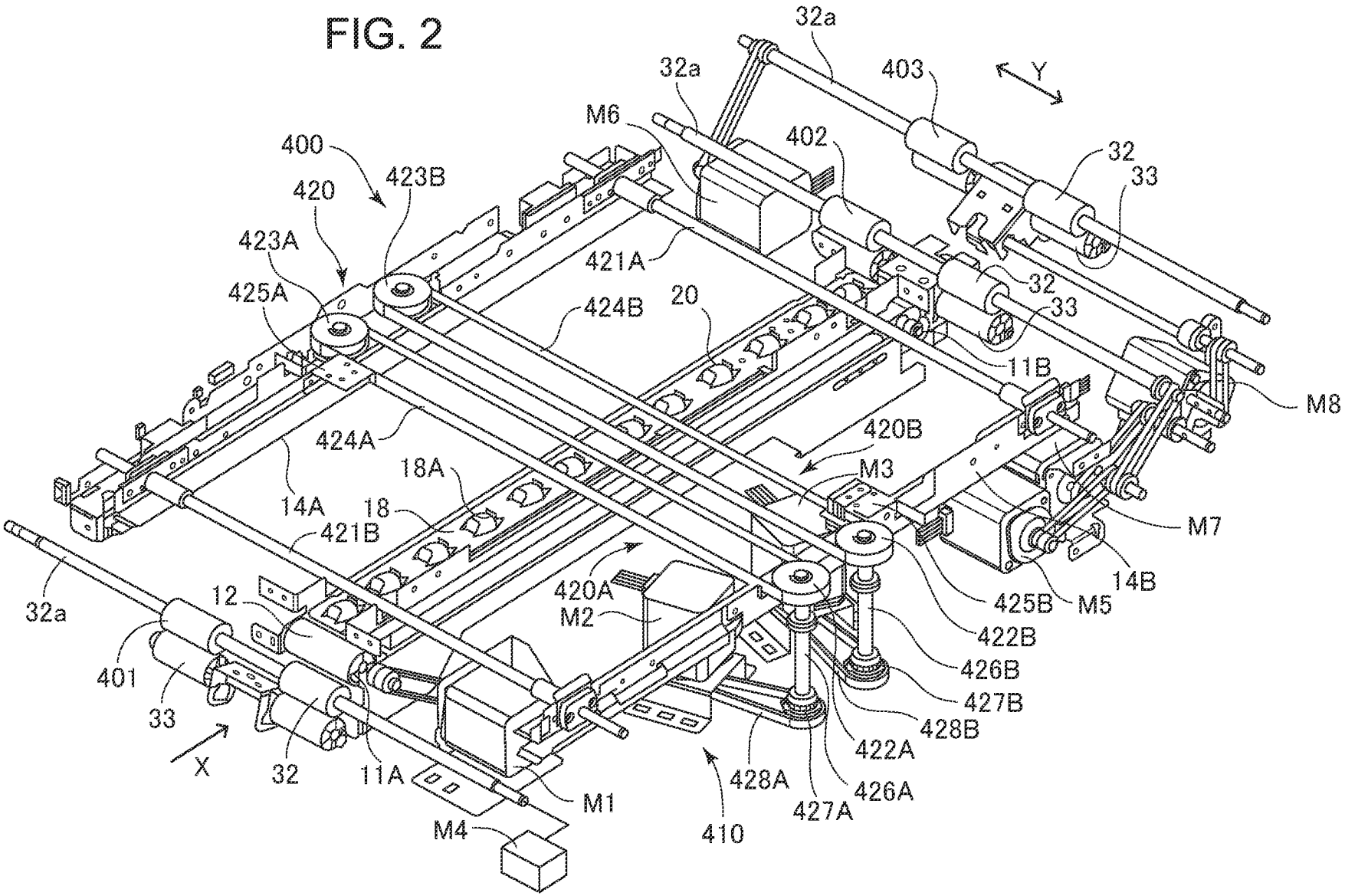
FIG. 2 is a perspective view of a relay conveying apparatus according to the Embodiment.
Figure 3:
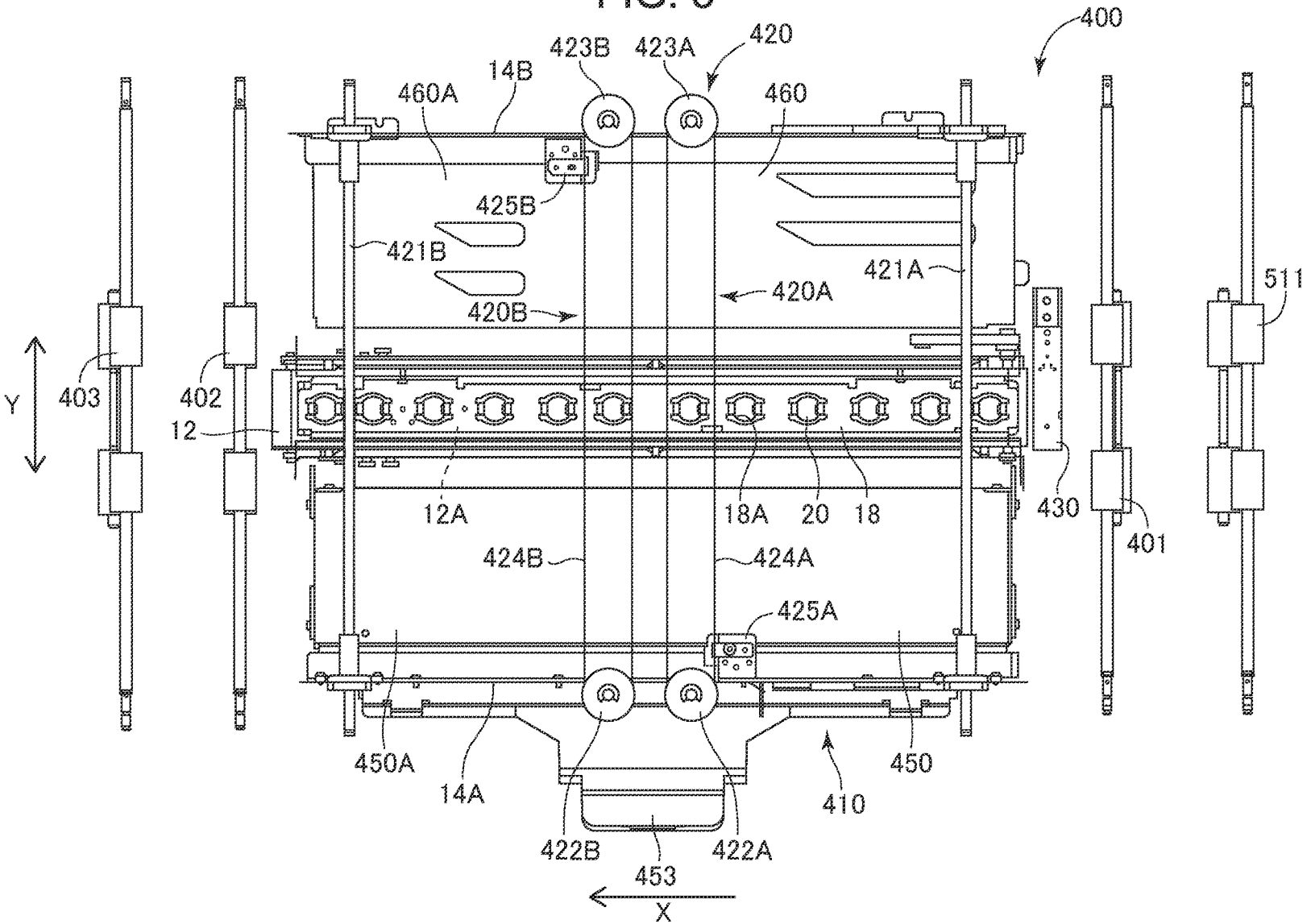
FIG. 3 is a plan view of the relay conveying apparatus according to the Embodiment.

A plurality of spheres 20 is disposed along the conveyance direction X in positions opposed to the conveyance face 12A of the conveyance belt 12. In this Embodiment, the plurality of spheres 20 is disposed above the conveyance belt 12. The plurality of spheres 20 is capable of rotating in any direction, while nipping the sheet with the conveyance face 12A. Therefore, each of the plurality of spheres 20 is held in a hold plate 18 provided above the conveyance belt 12 rotatably in any direction. In other words, as shown in FIGS. 2 and 3, the hold plate 18 is a long plate disposed along the conveyance direction X in a position spaced a predetermined distance apart from the conveyance face 12A above the conveyance belt 12, and has a plurality of hold holes 18A at a distance from one another in the conveyance direction X. Then, the hold holes 18A hold the spheres 20 rotatably, respectively.

Figure 4:
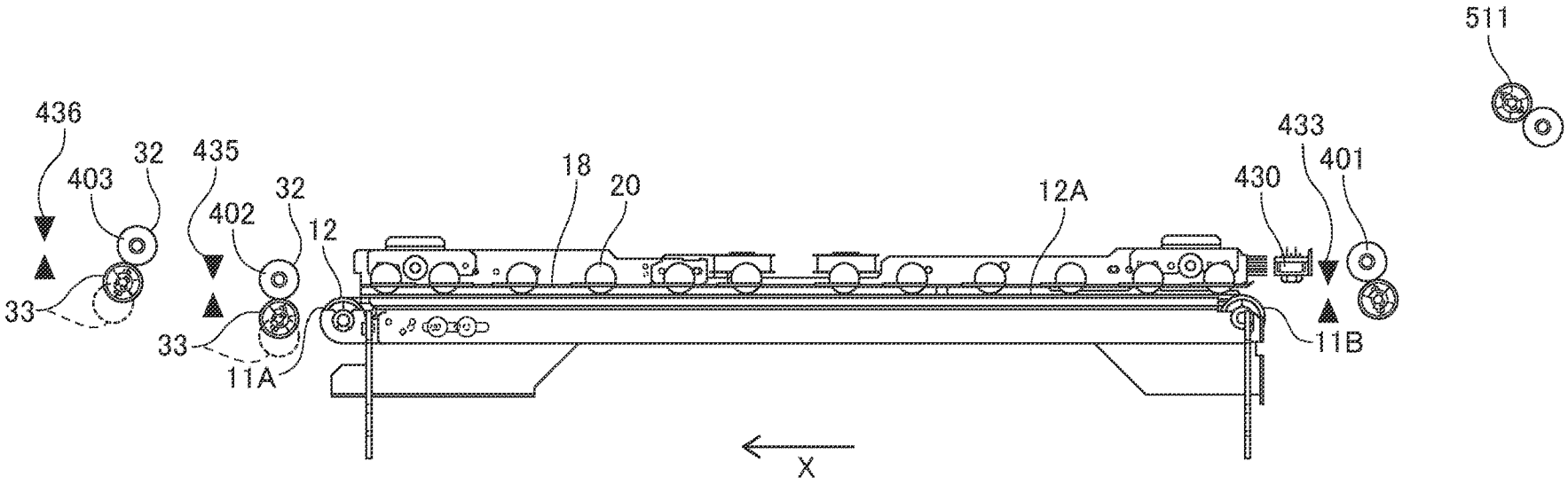
FIG. 4 is a side elevational view of the relay conveying apparatus according to the Embodiment.

As shown in FIG. 4, the sphere 20 is exposed from the hold hole 18A, is placed on the conveyance face 12A of the conveyance belt 12, and is made rotatable in any direction. Each of the spheres 20 is brought into contact with the conveyance face 12A under its own weight. In addition, the number of spheres 20 may be set corresponding to a pressing force required for the sheet conveyed on the conveyance belt 12. Further, since the sheet is conveyed, while slipping on the conveyance belt 12 as described later, the sphere 20 is preferably comprised of a material such as glass and plastic with a relatively low coefficient of friction. In addition, this Embodiment describes the configuration where the plurality of spheres 20 is arranged in a single line along the conveyance direction X, and a plurality of spheres 20 may be arranged and disposed in each of a plurality of lines such as two lines in the conveyance direction X.

A pair of regulation guides 14A, 14B are disposed on opposite sides of the conveyance belt 12, with respect to the sheet width direction Y (in this Embodiment, direction orthogonal to the conveyance direction) crossing the conveyance direction X. Then, the pair of regulation guides 14A, 14B are capable of guiding opposite end edges (opposite end edges in the sheet width direction) in the sheet width direction Y of the sheet that is conveyed by the conveyance belt 12 and the sphere 20, while being nipped. In other words, the regulation guide 14A, which is disposed on one side (front side of the apparatus) with respect to the sheet width direction Y, is capable of guiding the end edge on one side in the sheet width direction of the sheet that is conveyed by the conveyance belt 12 and the sphere 20, while being nipped. Further, the regulation guide 14B, which is disposed on the other side (rear side of the apparatus) with respect to the sheet width direction Y, is capable of guiding the end edge on the other side in the sheet width direction of the sheet that is conveyed by the conveyance belt 12 and the sphere 20, while being nipped. In addition, the one side (front side) in the sheet width direction Y is the side to operate the image forming system 1000.

Figure 5:
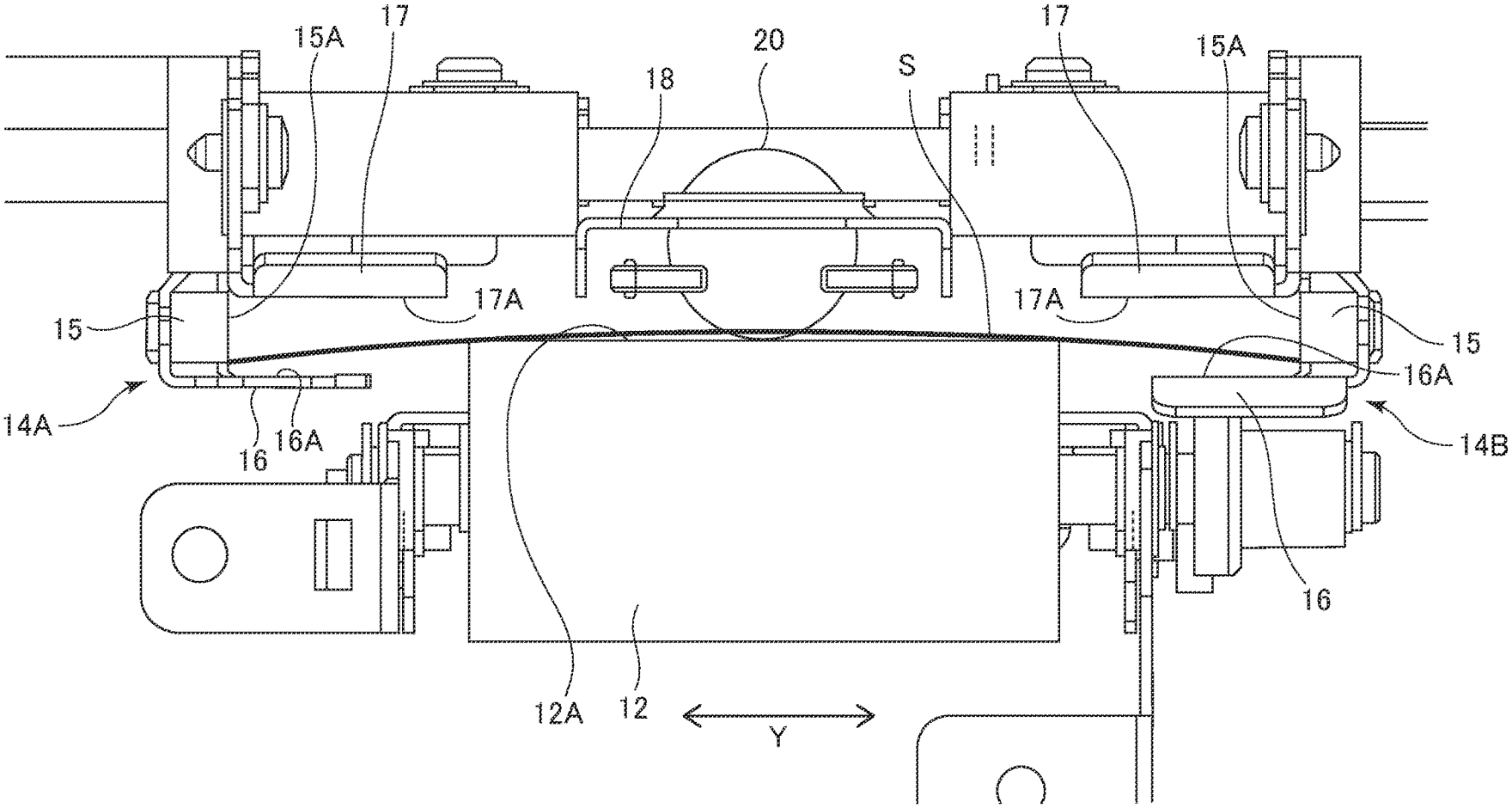
FIG. 5 is a cross-sectional view of the relay conveying apparatus according to the Embodiment.

As shown in FIG. 5, each of the pair of regulation guides 14A, 14B includes a side plate portion 15, lower plate portion 16, and upper plate portion 17, and enables the end portion of the sheet S conveyed by the conveyance belt 12 to enter a space surrounded by the plate portions 15, 16 and 17. The pair of regulation guides 14A, 14B are supported by support shafts 421A, 421B (see FIG. 3) to be able to shift to guide positions and retract positions by the guide shift section 420 described later. Each of the support shafts 421A, 421B is disposed substantially parallel with the sheet width direction Y, and supports end portion sides of the pair of regulation guides 14A, 14B in the conveyance direction X. The pair of regulation guides 14A, 14B are capable of shifting in the sheet width direction Y along the support shafts 421A, 421B.

The side plate portion 15 has a guide face 15A opposed to the end edge (end edge in the sheet width direction) in the sheet width direction Y of the sheet S that is conveyed by the conveyance belt 12 and the sphere 20, while being nipped, in the guide position. The guide face 15A is disposed parallel with the conveyance direction X. Further, the guide face 15A is a face orthogonal to each of the conveyance direction X and the sheet width direction Y, and in this Embodiment, is a face along the substantially vertical direction.

The lower plate portion 16 has a support face 16A which is disposed to be orthogonal to the side plate portion 15, and supports the end edge in the sheet width direction Y of the sheet S that is conveyed by the conveyance belt 12 and the sphere 20, while being nipped, in the guide position. The support face 16A is provided to extend substantially in the horizontal direction from a lower end portion of the guide face 15A in the vertical direction. Further, the support face 16A is positioned below the conveyance face 12A of the conveyance belt 12 in the vertical direction.

Herein, the case is considered where the support face 16A and conveyance face 12A are the same height, or the support face 16A is positioned above the conveyance face 12A in the vertical direction. In this case, when a sheet S such as thick paper with high stiffness is conveyed to between the conveyance belt 12 and the sphere 20 in a downward curled state (state in which the opposite end edges in the width direction Y are lower than the center) as shown in FIG. 5, the opposite end edges of the sheet S in the width direction Y are supported by the support faces 16A. At this point, the center portion of the sheet S in the width direction Y is in a state of being raised (in a bridged state), and pushes the sphere 20 up. As a result, the conveyance belt 12 and the sphere 20 are in a separate state, and there is the risk that the conveyance force of the conveyance belt 12 is not transferred to the sheet S, and that a conveyance failure occurs. Therefore, in this Embodiment, the support face 16A is disposed below the conveyance face 12A of the conveyance belt 12 in the vertical direction.

The upper plate portion 17 has an opposed face 17A disposed opposite the support face 16A. The opposed face 17A is positioned above the end edge in the sheet width direction Y of the sheet S that is conveyed by the conveyance belt 12 and the sphere 20, while being nipped, in the guide position. Further, the opposed face 17A is formed substantially parallel with the support face 16A.

As shown in FIGS. 2 and 3, the guide shift section 420 as a guide shift section has a first shift section 420A for shifting the regulation guide 14A on one side in the pair of regulation guides 14A, 14B, and a second shift section 420B for shifting the regulation guide 14B on the other side. Further, the guide shift section 420 has a motor M2 for generating a driving force to shift the regulation guide 14A, and a motor M3 for generating a driving force to shift the regulation guide 14B on the other side.

The first shift section 420A has a pair of pulleys 422A, 423A, an endless belt 424A looped between both of the pulleys 422A, 423A, and a connection portion 425A for connecting between the belt 424A and the regulation guide 14A. Similarly, the second shift section 420B has a pair of pulleys 422B, 423B, an endless belt 424B looped between both of the pulleys 422B, 423B, and a connection portion 425B for connecting between the belt 424B and the regulation guide 14B on the other side.

Further, as shown in FIG. 2, the first shift section 420A is driven by the motor M2 as a drive source, and the second shift section 420B is driven by the motor M3 as a drive source. In other words, in the case of this Embodiment, different motors are used as drive sources for shifting the pair of regulation guides 14A, 14B, respectively, and the pair of regulation guides 14A, 14B are capable of shifting independently of each other. Therefore, the pulley 422A of the first shift section 420A is coupled to a pulley 427A via a coupling shaft 426A, and a belt 428A is looped between the pulley 427A and a pulley driven to rotate by the motor M2. Then, rotation drive of the motor M2 is transferred to the belt 424A via the belt 428A, pulley 427A, coupling shaft 426A, and pulley 422A. As described above, since the belt 424A is connected to the regulation guide 14A via the connection portion 425A, by drive of the motor M2, the regulation guide 14A shifts in the sheet width direction Y along the support shafts 421A, 421B.

Similarly, the pulley 422B of the second shift section 420B is coupled to a pulley 427B via a coupling shaft 426B, and a belt 428B is looped between the pulley 427B and a pulley driven to rotate by the motor M3. Then, rotation drive of the motor M3 is transferred to the belt 424B via the belt 428B, pulley 427B, coupling shaft 426B, and pulley 422B. As described above, since the belt 424B is connected to the regulation guide 14B on the other side via the connection portion 425B, by drive of the motor M3, the regulation guide 14B on the other side shifts in the sheet width direction Y along the support shafts 421A, 421B.

By thus driving the motors M2, M3, the regulation guides 14A, 14B are shifted to the guide positions and retract positions, respectively. In the case of this Embodiment, each of the motors M2, M3 is a pulse motor (stepping motor), and a position of each of the regulation guides 14A, 14B is controlled by the number of pulses sent to the motor, respectively. Further, each of the regulation guides 14A, 14B has a home position, and a sensor for detecting each of the regulation guides 14A, 14B is provided in the home position, respectively. Therefore, positions of the regulation guides 14A, 14B are detected in home positions, and subsequently, using the number of pulses sent to the motor, each of the regulation guides 14A, 14B is shifted to the guide position and the retract position.

In addition, in the case of this Embodiment, the motor M1 for driving the conveyance belt 12 described above, the motors M2, M3 for shifting the regulation guides 14A, 14B, and motors M5, M7, M8 described later are disposed on the other-side regulation guide 14B side. Particularly, with respect to the conveyance direction X, motors within a conveyance range of the sheet of the misregistration correcting section 410 are preferably disposed on the rear side of the conveyance belt 12 (the other-side regulation guide 14B side). This is because the case of this Embodiment is configured to remove a jammed sheet from the front side (one-side regulation guide 14A side).

Further, in the case of this Embodiment, as shown in FIGS. 3 and 4, a multi feed detecting sensor 430 for detecting multi feed of sheets is disposed between the conveyance roller pair 401 on the upstream side and the conveyance belt 12. For example, the multi feed detecting sensor 430 is a sensor for detecting that two or more sheets are stacked and conveyed by an ultrasonic wave. In the case of detecting multi feed of sheets by the multi feed detecting sensor 430, the control section 203 (FIG. 1) of the multi-stage feed apparatus 200 conveys the multi-fed sheets to the multi feed sheet storage section 218 via the relay conveying apparatus 400, and the conveyance paths 215, 217.

Further, as shown in FIG. 4, the relay conveying apparatus 400 of this Embodiment has a plurality of sheet detecting sensors 433, 435, 436 to detect a jam of a sheet. In addition, the jam of a sheet is that the sheet remains in the conveyance path by jamming or the like. The sheet detecting sensor 433 as an upstream-side detecting section is disposed on the upstream side (upstream side in the conveyance direction) relative to the conveyance belt 12 in the conveyance direction X, and detects the presence or absence of the sheet. A sheet detecting sensor 431 is disposed between the conveyance belt 12 and the conveyance roller pair 401.

The sheet detecting sensor 435 as a detecting section or a first detecting section is disposed on the downstream side (downstream side in the conveyance direction) relative to the conveyance belt 12 in the conveyance direction X, and detects the presence or absence of the sheet. The sheet detecting sensor 435 is disposed between the conveyance roller pair 402 and the conveyance roller pair 403 disposed on the downstream side relative to the conveyance belt 12. The sheet detecting sensor 436 as a detecting section or a second detecting section is disposed on the downstream side relative to the sheet detecting sensor 435 in the conveyance direction X, and detects the presence or absence of the sheet. The sheet detecting sensor 436 is disposed downstream side relative to the conveyance roller pair 403. The sheet detecting sensors 435, 436 correspond to downstream-side detecting sections.

Based on detection signals of various sheet detecting sensors such as the sheet detecting sensors 433, 435, 436, the control section 203 (FIG. 1) of the multi-stage feed apparatus 200 determines whether or not a sheet is jammed in the conveyance path. Then, in the case where the control section 203 determines that the sheet is jammed, the section 203 halts conveyance of the sheet, and displays the jam of the sheet and a portion of the jam on a display section such as a liquid crystal panel provided in the image forming system 1000. At this point, the section urges an operator such as a user and service person to open a door of the corresponding portion.

Further, in the case of this Embodiment, as shown in FIG. 3, with respect to the sheet width direction Y, opposed members 450, 460 opposed to the backside of the sheet conveyed by the conveyance belt 12 are disposed between the conveyance belt 12 and the pair of regulation guides 14A, 14B. In the case where an end portion of a sheet is conveyed, without being supported by any of the regulation guides 14A, 14B, the opposed members 450, 460 support the end portion of the sheet.

The relay conveying apparatus 400 thus configured nips the sheet delivered from the conveyance roller pair 401 upstream in the conveyance direction X to the conveyance belt 12 with the conveyance belt 12 and the sphere 20. Then, the sheet is conveyed by rotation of the conveyance belt 12. At this point, although details will be described later, the apparatus causes the opposite ends in the width direction Y of the sheet conveyed by the conveyance belt 12 to strike the guide faces 15A of the pair of regulation guides 14A, 14B. When the sheet is struck by the guide faces 15A, the sheet is conveyed in a direction parallel with the guide faces 15A, while causing the opposite side ends to move along the guide faces 15A and slipping between the conveyance belt 12 and the face. At this point, the sheet is nipped by the conveyance belt 12 and the sphere 20, and since the sphere 20 is rotatable in any direction, is capable of shifting, while slipping on the conveyance belt 12 in any direction. By this means, the side registration and side skew of the sheet is corrected.

[Regulation Guide]

Next, descriptions will be given to the detailed configuration of the regulation guides 14A, 14B as the first regulation guide and the second regulation guide, with reference to FIGS. 6A to 6D. In addition, although FIGS. 6A to 6D illustrate only the regulation guide 14A on one side, the regulation guide 14B on the other side also has the same configuration. As shown in FIG. 5, the regulation guide 14A includes the side plate portion 15 having the guide face 15A, the lower plate portion 16 having the support face 16A, and the upper plate portion 17 having the opposed face 17A.

Figure 6A:
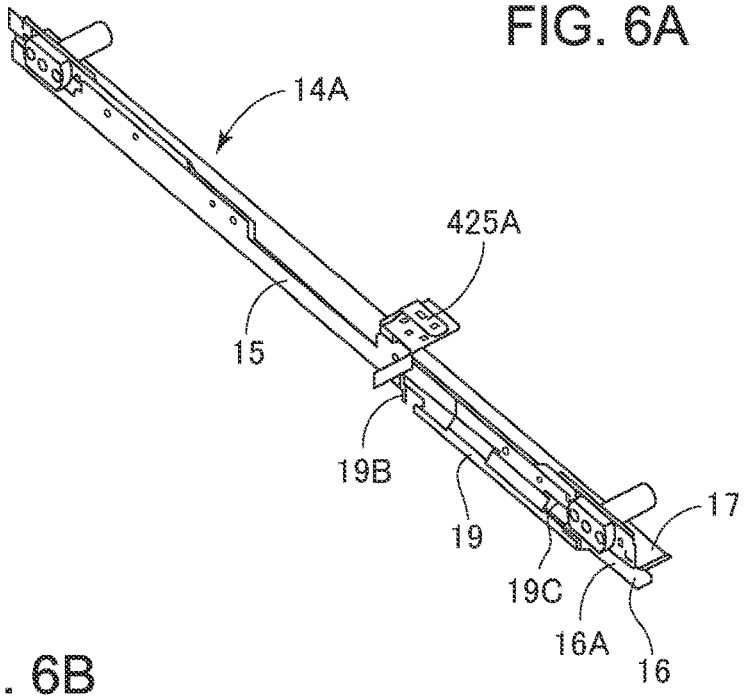
FIG. 6A is a perspective view of a regulation guide according to the Embodiment.
Figure 6B:
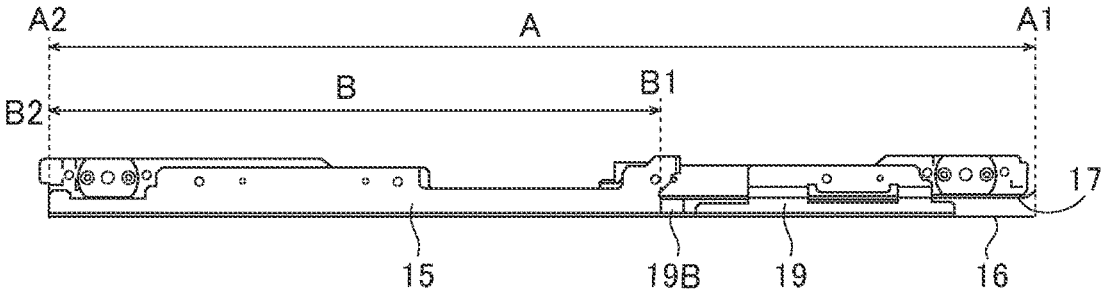
FIG. 6B is a view of the guide looking from the left side in FIG. 6A.

As shown in FIGS. 6A and 6B, the lower plate portion 16 and upper plate portion 17 are provided continuously over almost the entire area in the longitudinal direction of the regulation guide 14A. As shown in FIG. 2 and so on, since the regulation guide 14A is disposed substantially parallel with the conveyance direction X, a predetermined region A refers to a range where the lower plate portion 16 and upper plate portion 17 are continuous with respect to the conveyance direction X. Accordingly, in this Embodiment, the support face 16A of the lower plate portion 16 and the opposed face 17A of the upper plate portion 17 are provided continuously over the predetermined region A with respect to the conveyance direction X. The predetermined region A is almost the entire area of the region where the sheet is conveyed by the misregistration correcting section 410.

Figure 6C:
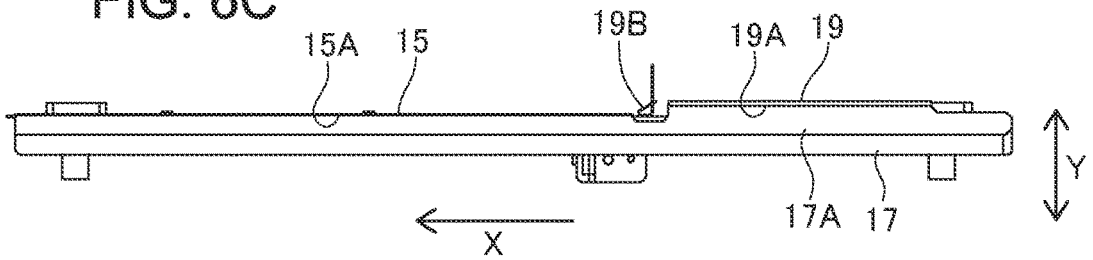
FIG. 6C is a cross-sectional view of the guide taken in a direction along a conveyance direction of a sheet.
Figure 6D:
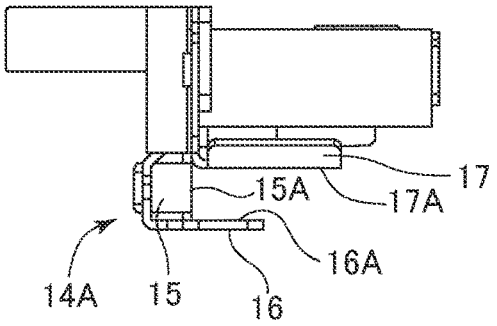
FIG. 6D is a cross-sectional view of the guide taken in a direction orthogonal to the conveyance direction of the sheet.

On the other hand, as shown in FIGS. 6A to 6C, the side plate portion 15 is provided continuously over a guide region B that is a region shorter than the predetermined region A. In this Embodiment, an upstream end (upstream end in the conveyance direction) B1 of the side plate portion 15 in the conveyance direction X is positioned on the downstream side from an upstream end A1 of the predetermined region A in the conveyance direction X. In other words, the upstream end B1 of the guide face 15A of the side plate portion 15 in the conveyance direction X is positioned on the downstream side from the upstream end A1 of the predetermined region A. Further, with respect to the conveyance direction X, the guide face 15A is provided continuously up to a downstream end A2 of the predetermined region A. Accordingly, a position of a downstream end B2 of the side plate portion 15 in the conveyance direction X and a position of the downstream end A2 of the predetermined region A in the conveyance direction X are almost the same position with respect to the conveyance direction X.

In this Embodiment, a notch 19C is provided on the upstream side from the upstream end B1 of the side plate portion 15. Then, in a part of the notch 19C is disposed an outer plate portion 19 positioned on the outer side of the side plate portion 15 in the sheet width direction Y. The outer side in the sheet width direction Y is a side spaced apart from the conveyance belt 12 with respect to the sheet width direction Y. Therefore, as shown in FIG. 6C, an inner face 19A of the outer plate portion 19 is positioned on the outer side in the sheet width direction Y than the guide face 15A that is the inner face of the side plate portion 15. Further, with respect to the conveyance direction X, between the outer plate portion 19 and the side plate portion 15 is provided an inclined plate portion 19B inclined closer to the side plate portion 15, as going downstream.

Each of the pair of regulation guides 14A, 14B is configured as described above, and a distance in the width direction Y between the inner faces 19A of the outer plate portions 19 on the upstream side in the conveyance direction X is thereby wider than a distance in the width direction Y between the guide faces 15A of the side plate portions 15. Therefore, as described later in detail, the opposite end edges in the width direction Y of the sheet delivered from the conveyance roller pair 401 on the upstream side to the conveyance belt 12 are positioned between the inner faces 19A on the upstream side in the conveyance direction X, and by conveying to the downstream side, are positioned between the guide faces 15A.

In addition, the outer plate portion 19 and inclined plate portion 19B may be omitted. However, in the case where the end portion in the width direction Y of the sheet delivered from the conveyance roller pair 401 on the upstream side to the conveyance belt 12 is positioned inside the notch 19C, when the sheet is further conveyed, there is the risk that the end portion of the sheet is caught in the upstream end B1 of the side plate portion 15. Therefore, in this Embodiment, the outer plate portion 19 and inclined plate portion 19B are provided, and it is configured that also in the case where the sheet is conveyed, while being displaced from a normal position in the width direction Y, the outer plate portion 19 regulates a position of the sheet, and that the inclined plate portion 19B further guides the end portion of the sheet to the guide face 15A of the side plate portion 15.

[Contact-Separation Configuration of the Conveyance Roller Pair]

Figure 7:
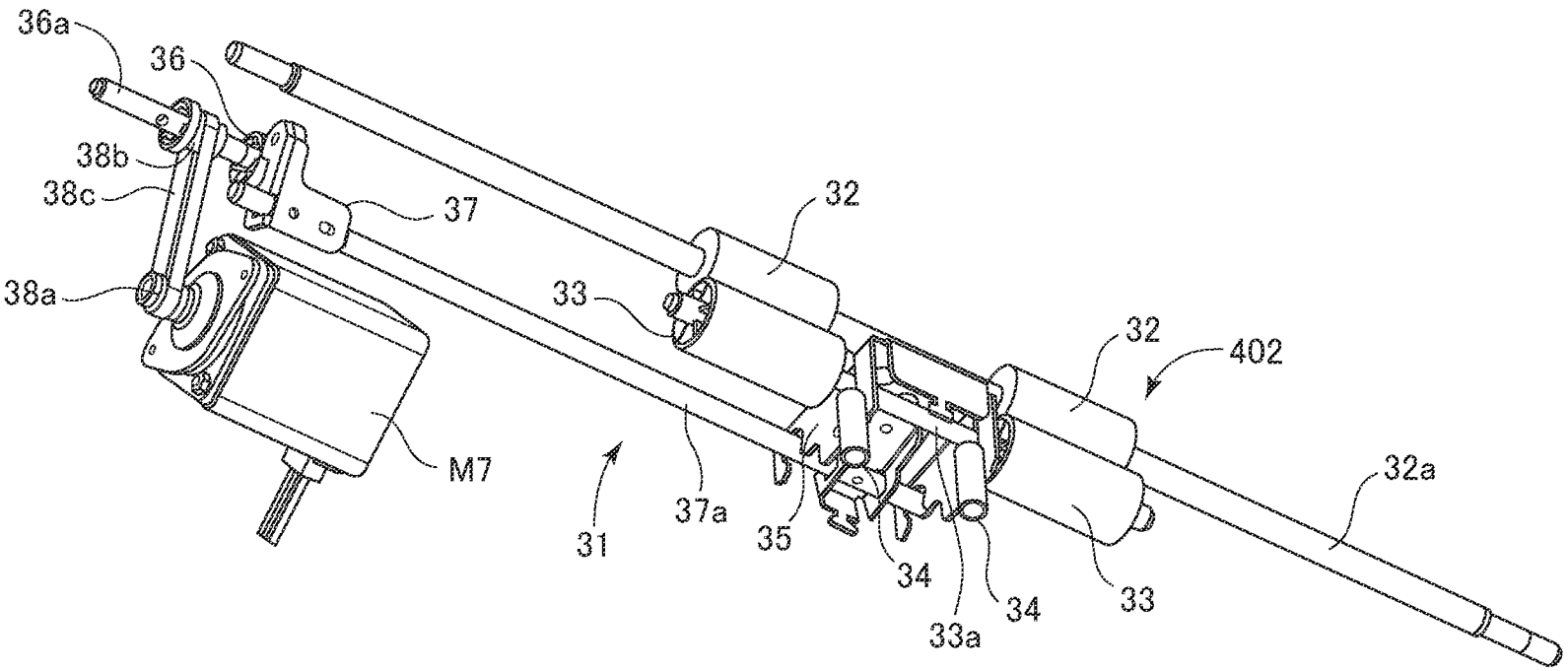
FIG. 7 is a perspective view illustrating a contact-separation mechanism of conveyance rollers according to the Embodiment.

Next, referring to FIGS. 1 and 2, the contact-separation configuration of the conveyance roller pairs 401 to 403 will be described using FIGS. 7, 8A and 8B. As described above, each of the conveyance roller pairs 401 to 403 is disposed upstream or downstream side relative to the conveyance belt 12 in the conveyance direction X. Each of the conveyance roller pairs 401 to 403 has a drive roller 32 and driven roller 33 as a pair of conveyance rollers. The drive roller 32 is an elastic roller where an elastic body such as rubber is provided around a rotation shaft 32*a*. The driven roller 33 comes into contact with the drive roller 32 to form the nip portion for nipping the sheet to convey. The drive roller 32 of the conveyance roller pair 401, the drive roller 32 of the conveyance roller pair 402, and the drive roller 32 of the conveyance roller pair 403 are capable of being driven to rotate independently of one another, by a motor M4, motor M5 and motor M6, respectively.

In this Embodiment, the conveyance roller pairs 402, 403 disposed on the downstream side (downstream side in the conveyance direction) relative to the conveyance belt 12 in the conveyance direction X have the configuration for enabling the drive roller 32 and driven roller 33 to come into contact and separate with/from each other. By a motor M7 and motor M8, the conveyance roller pairs 402, 403 enable the drive roller 32 and driven roller 33 to come into contact and separate with/from each other independently, respectively. Since configurations of the conveyance roller pairs 402, 403 are the same, the contact-separation configuration will be described below using the conveyance roller pair 402 as an example, with reference to FIGS. 7, 8A and 8B.

A contact-separation mechanism 31 for causing the drive roller 32 and driven roller 33 to come into contact and separate with/from each other has a compression spring 34 as a biasing member, support member 35, motor M7, separation cam 36 and link member 37. The contact-separation mechanism 31 corresponds to a roller shift section for enabling at least one of the pair of conveyance rollers i.e. the driven roller 33 to shift to a nip position for enabling a sheet to be nipped and conveyed, and a nip release position where the pair of conveyance rollers are separate from the nip position.

The compression spring 34 is a spring for biasing the driven roller 33 toward the drive roller 32. The support member 35 supports a rotation shaft 33*a* of the driven roller 33, and is supported swingably around a swing shaft 37*a* as the center. Further, the support member 35 is biased by the compression spring 34 in a direction for pressing the driven roller 33 to the drive roller 32 with the swing shaft 37*a* as the center. The support member 35 is fixed to the swing shaft 37*a*, rotates together with the swing shaft 37*a*, and shifts the driven roller 33 in a direction for approaching the drive roller 32 and in a direction for separating from the drive roller 32.

The motor M7 drives the separation cam 36 to rotate via pulleys 38*a*, 38*b*, and a belt 38*c*. The pulley 38*a* is fixed to a drive shaft of the motor M7, and the pulley 38*b* is fixed to a rotation shaft 36*a* of the separation cam 36. The belt 38*c* is an endless belt looped between the pulleys 38*a*, 38*b*. The separation cam 36 is an eccentric cam that the center of the outer circumferential surface is eccentric from the center of the rotation shaft 36*a*, and rotates together with the rotation shaft 36*a* by drive of the motor M7.

The link member 37 is fixed to the swing shaft 37*a*, and is provided swingably together with the swing shaft 37*a*. Accordingly, the link member 37 rotates in synchronization with the support member 35 via the swing shaft 37*a*. The link member 37 is disposed to come into contact with the separation cam 36, by the support member 35 being biased by the compression spring 34.

Figure 8A:
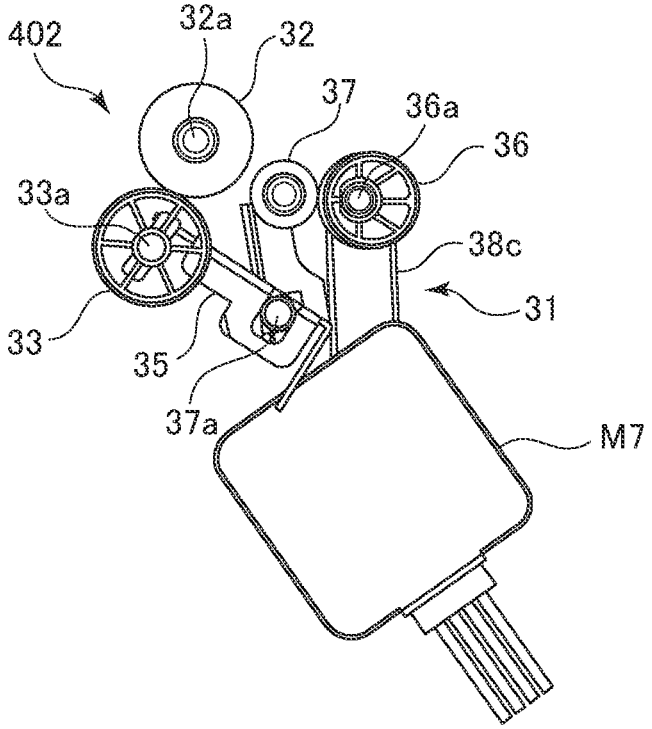
FIG. 8A is a side elevational view illustrating a nip state of the conveyance rollers of the contact-separation mechanism of conveyance rollers according to the Embodiment.

In the case where the separation cam 36 is in a phase shown in FIG. 8A, the driven roller 33 is brought into press-contact with the drive roller 32 by the biasing force of the compression spring 34. The state of FIG. 8A is the nip position. From this state, for example, when the separation cam 36 is driven to rotate 180° by the motor M7, as shown in FIG. 8B, the link member 37 is pressed by the separation cam 36 to swing around the swing shaft 37*a* as the center in a counterclockwise direction in the figure. Then, the support member 35 coupled to the link member 37 via the swing shaft 37*a* swings around the swing shaft 37*a* as the center in the same direction. The driven roller 33 is supported by the support member 35 via the rotation shaft 33*a*, and therefore, by the swing of the support member 35, separates from the drive roller 32. In other words, the driven roller 33 is shifted to the nip release position.

Figure 8B:
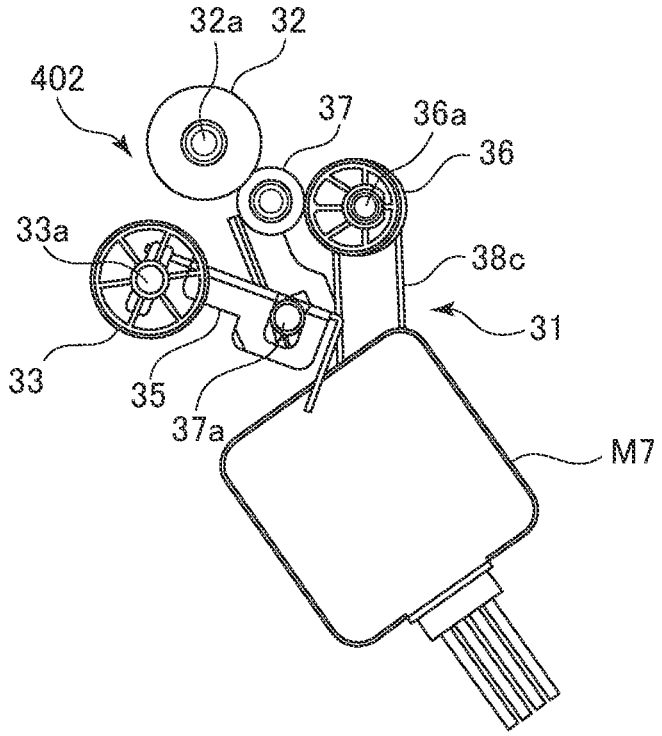
FIG. 8B is a side elevational view illustrating a nip release state of the conveyance rollers.
Figure 9:
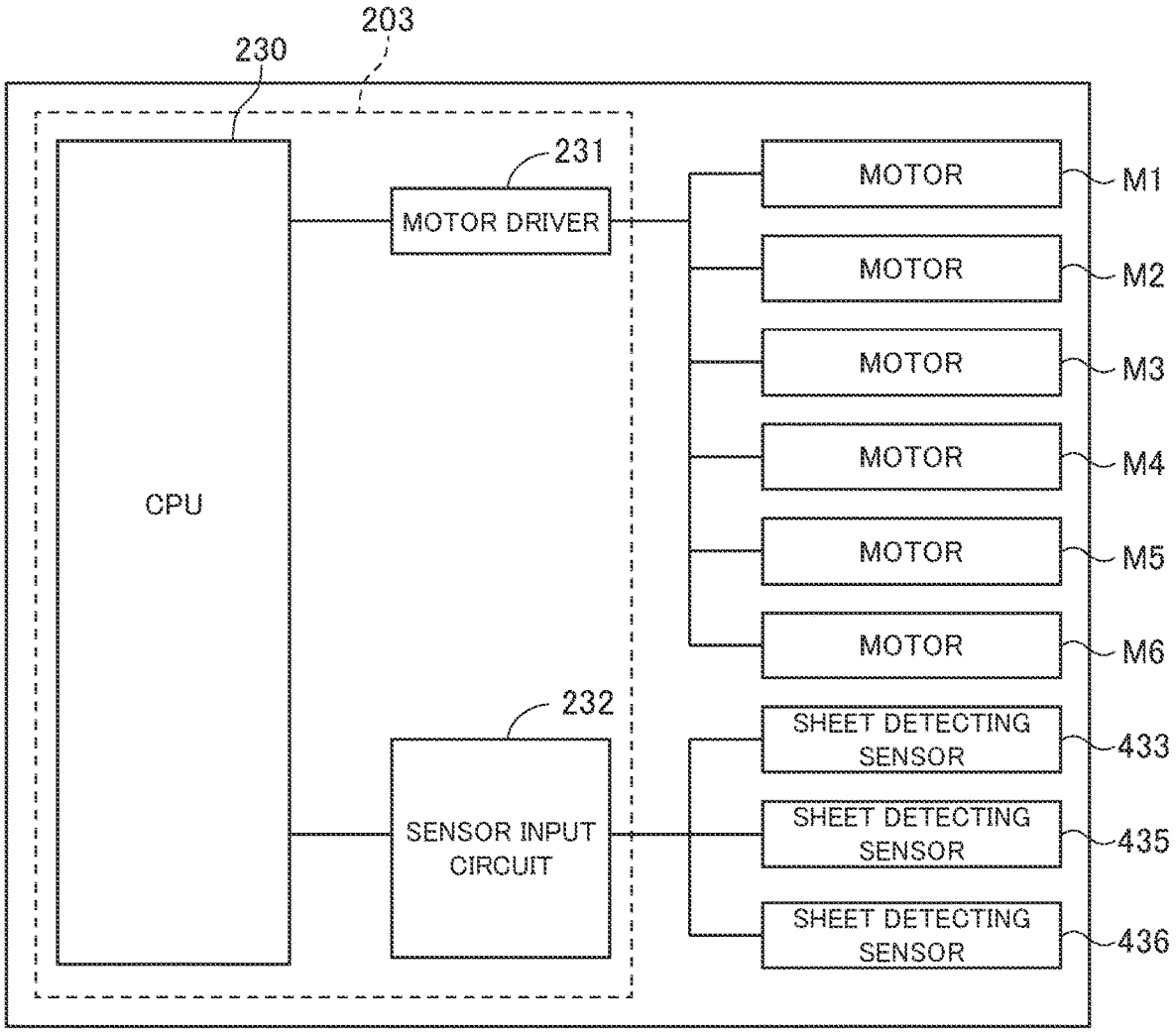
FIG. 9 is a block diagram in relation to sheet conveyance control according to the Embodiment.

In the case of shifting the driven roller 33 from the nip release position to the nip position, the separation cam 36 is further rotated 180° from the state of FIG. 8B by the motor M7. In addition, the contact-separation mechanism for causing the drive roller 32 and driven roller 33 to come into contact and separate with/from each other may be a configuration for shifting both the drive roller 32 and the driven roller 33. Further, in the above-mentioned example, the contact-separation mechanism is driven by the motor, and contact and separation of a pair of conveyance rollers may be performed by another drive source such as a solenoid.

Further, in the above-mentioned example, the conveyance roller pairs 402, 403 on the downstream side relative to the conveyance belt 12 in the conveyance direction X are allowed to come into contact and separate, and only the conveyance roller pair 402 may be allowed to come into contact and separate. Further, the conveyance roller pair 401 on the upstream side relative to the conveyance belt 12 in the conveyance direction X may be allowed to come into contact and separate. In this case, only the conveyance roller pair 401 on the upstream side may be allowed to come into contact and separate, and also the conveyance roller pair 402 on the downstream side and further, also the conveyance roller pair 403 may be allowed to come into contact and separate.

[Sheet Conveyance Operation]

Sheet conveyance operation in the relay conveying apparatus 400 in this Embodiment will be described next. First, a control configuration for various motors and various sensors in control of sheet conveyance operation will be described with reference to FIG. 9. A control board of the control section 203 has a CPU (or ASIC) 230, motor driver 231, and sensor input circuit 232. The CPU 230 performs detection of sheet conveyance timing, sheet jam and the like, using output signals from the sheet detecting sensors 433, 434, 435 and the like. Particularly, in this Embodiment, based on output signals from the sheet detecting sensors 433, 434, 435, the CPU 230 performs control of various motors M1 to M6. As described above, the motor M1 drives the conveyance belt 12, the motors M2, M3 shift the pair of regulation guides 14A, 14B, the motor M4 drives the conveyance roller pair 401, the motor M5 drives the conveyance roller pair 402, and the motor M6 drives the conveyance roller pair 403.

Next, referring to FIGS. 2 to 4 and so on, a specific example of conveyance control of the sheet will be described using FIGS. 9 to 11D. In this Embodiment, the control section 203 controls the motors M2, M3 corresponding to a conveyance state of the sheet, and changes positions of the pair of regulation guides 14A, 14B in the sheet width direction Y. As described above, by controlling the motors M2, M3, and thereby driving the guide shift section 420 (FIG. 2), it is possible to shift the pair of regulation guides 14A, 14B to the guide positions and retract positions.

Herein, the guide positions are positions for enabling the guide faces 15A of the pair of regulation guides 14A, 14B to guide the end edges in the width direction Y of the sheet that is conveyed by the conveyance belt 12 and the sphere 20, while being nipped. In this Embodiment, the guide positions are positions where a distance between the guide faces 15A (between the guide faces) of the pair of regulation guides 14A, 14B is longer than a length in the sheet width direction Y of the sheet that is conveyed by the conveyance belt 12 and the sphere 20, while being nipped.

Specifically, in a state in which a center position of the sheet in the width direction Y coincides with a center position between the guide faces 15 on the opposite sides and in a state in which the end edges of the sheet in the width direction Y are parallel with the guide faces 15A (center reference), when the sheet is conveyed, the guide positions are positions where a predetermined distance is made between the end edge of the sheet in the width direction Y and the guide face 15A. The predetermined distance is capable of being set as appropriate according to the apparatus, and is a distance capable of permitting displacement between the sheet and an image formed on the sheet when the sheet is displaced within the distance. For example, the predetermined distance is 0.5 mm. In other words, in the guide positions, the guide faces 15A of the pair of regulation guides 14A, 14B are in positions spaced 0.5 mm apart from the end edges of the sheet in the width direction Y, respectively. The control section 203 is capable of changing the guide position as appropriate corresponding to the sheet size.

Thus, in the guide positions, since the pair of regulation guides 14A, 14B are positioned in the positions where the distance between the guide faces 15A of the pair of regulation guides 14A, 14B is longer than the length of the sheet in the sheet width direction Y, it is possible to suppress a conveyance load of the sheet conveyed by the conveyance belt 12. For example, in the case where the distance between the guide faces is the same as the length of the sheet in the width direction Y, the sheet is conveyed with the end portions of the sheet rubbing against the guide faces, and conveyance resistance is increased. Particularly, in this Embodiment, since the sheet is nipped and conveyed by the conveyance belt 12 and the sphere 20, the nip pressure for nipping the sheet by the conveyance belt 12 and the sphere 20 is low. Therefore, when the conveyance resistance of the sheet is high, there is the risk that a conveyance failure tends to occur such that a delay occurs in conveyance of the sheet, and that conveyance of the sheet is halted. Therefore, in this Embodiment, by positioning the pair of regulation guides 14A, 14B in the guide positions as described above, it is configured to suppress the conveyance resistance of the sheet.

In addition, it is preferable to correct (perform alignment operation) the side registration and side skew of the sheet as described later, by conveying the sheet with the center reference as described above. This is because in this Embodiment, correction of the side skew is made, by slipping the sheet between the conveyance belt 12 and the sphere 20 and rotating the sheet. In other words, by starting the alignment operation in the position (center reference)

where gravity of the sheet S substantially coincides with the center portion of the regulation guides 14A, 14B, it is possible to reduce damage to the sheet at the time of the alignment operation.

On the other hand, the retract positions are positions where the guide faces 15A of the pair of regulation guides 14A, 14B are retracted from the end edges of the sheet in the width direction Y more than the guide positions. In other words, the distance in the width direction Y between the guide faces 15A of the pair of regulation guides 14A, 14B in the retract positions is wider than the distance in the width direction Y between the guide faces 15A of the pair of regulation guides 14A, 14B in the guide positions.

In this Embodiment, the retract position is a position where a distance is 5 mm from the end edge in the width direction Y of the sheet conveyed with the above-mentioned center reference. In addition, the sheet S is delivered to the conveyance belt 12 in a state in which the regulation guides 14A, 14B are in the retract positions, and in this state, a shift of the sheet S in the vertical direction is regulated by the support faces 16A and opposed faces 17A. By this means, even in the case where the sheet S is curled, when the regulation guides 14A, 14B shift from the retract positions to the guide positions, it is possible to accommodate the opposite end edges of the sheet S within the region surrounded by the guide faces 15A, support faces 16 and opposed faces 17A.

In this Embodiment, before the sheet is delivered to the conveyance belt 12, the pair of regulation guides 14A, 14B are positioned in the retract positions. Then, after a front end of the sheet is delivered to the conveyance belt 12 and a rear end of the sheet passes through the conveyance roller pair on the upstream side, the pair of regulation guides 14A, 14B are shifted from the retract positions to the guide positions. Specifically, when the rear end of the sheet passes through the sheet detecting sensor 433 disposed between the conveyance belt 12 and the conveyance roller pair 401, the pair of regulation guides start to shift from the retraction positions to the guide positions. Then, the pair of regulation guides 14A, 14B guide the sheet in the guide positions, and side registration and side skew of the sheet is thereby corrected.

At this point, the sheet is conveyed in a state of being nipped by the conveyance belt 12 and the spheres 20. A force (nip force) for the conveyance belt 12 and the spheres 20 to nip the sheet is set to be weak so as to make corrections of side registration and side skew of the sheet. Therefore, in the case where the sheet comes into contact with at least one of the regulation guides 14A, 14B and a friction force is large between the sheet and the regulation guide, even when the conveyance belt 12 is still driven, the sheet is not conveyed, or there is the risk that a conveyance velocity is extremely slow. Then, when the sheet detecting sensor 435 on the downstream side relative to the conveyance belt 12 does not detect the sheet for a predetermined time, the control section 203 determines that a jam of the sheet occurs, and halts the apparatus. Thus, when the apparatus is halted due to that the sheet comes into contact with the regulation guide and is hard to convey, productivity is decreased.

Therefore, in this Embodiment, in the case where the sheet comes into contact with the regulation guide and is thereby hard to convey, while continuing drive of the conveyance belt 12, the pair of regulation guides 14A, 14B are shifted toward the retract positions. In other words, in the case where the sheet detecting sensor 435 on the downstream side relative to the conveyance belt 12 does not detect the sheet after a lapse of a first predetermined time since the pair of regulation guides 14A, 14B shift from the retract positions to the guide positions, the control section 203 performs retract operation. The retract operation is operation for shifting the pair of regulation guides 14A, 14B from the guide positions to the retract positions in a state of continuing to drive the conveyance belt 12 in a direction for conveying the sheet. For example, the first predetermined time (predetermined time) is 500 ms.

By this means, the regulation guides coming into contact with the sheet separate from the sheet, and the sheet is conveyed by the conveyance belt 12. Then, without the control section 203 determining a jam, conveyance of the sheet is continued, and it is possible to suppress reductions in productivity. In addition, after performing the above-mentioned retract operation, in the case where the sheet detecting sensor 435 does not detect the sheet after a lapse of a second predetermined time, the control section 203 determines that the sheet jams, and halts drive of the conveyance belt 12. The second predetermined time may be shorter or longer than the first predetermined time, or may be the same as the first predetermined time, but it is preferable to set to be shorter than the first predetermined time. For example, the second predetermined time is 100 ms.

Further, this Embodiment illustrates the aspect of performing the retract operation in the case where the sheet detecting sensor 435 on the downstream side relative to the conveyance belt 12 does not detect the sheet after a lapse of the first predetermined time since the pair of regulation guides 14A, 14B shift from the retract positions to the guide positions, and as a substitute for the time, a drive amount of the conveyance belt 12 may be counted. In this case, a first predetermined drive amount that corresponds to the first predetermined time is 1910 pulses, and a second predetermined drive amount that corresponds to the second predetermined time is 382 pulses. In other words, the retract operation is performed in the case where the sheet detecting sensor 435 on the downstream side relative to the conveyance belt 12 does not detect the sheet in driving the conveyance belt 12 by the first predetermined drive amount (1910 pulses) (in continuing by a predetermined amount) after the pair of regulation guides 14A, 14B shift from the retract positions to the guide positions, and after the retract operation is performed, in the case where the sheet detecting sensor 435 does not detect the sheet in driving the conveyance belt 12 by the second predetermined drive amount (382 pulses), the control section 203 determines that the sheet jams, and halts drive of the conveyance belt 12. In addition, the first predetermined drive amount and the second predetermined drive amount may be the same drive amount.

Figure 10:
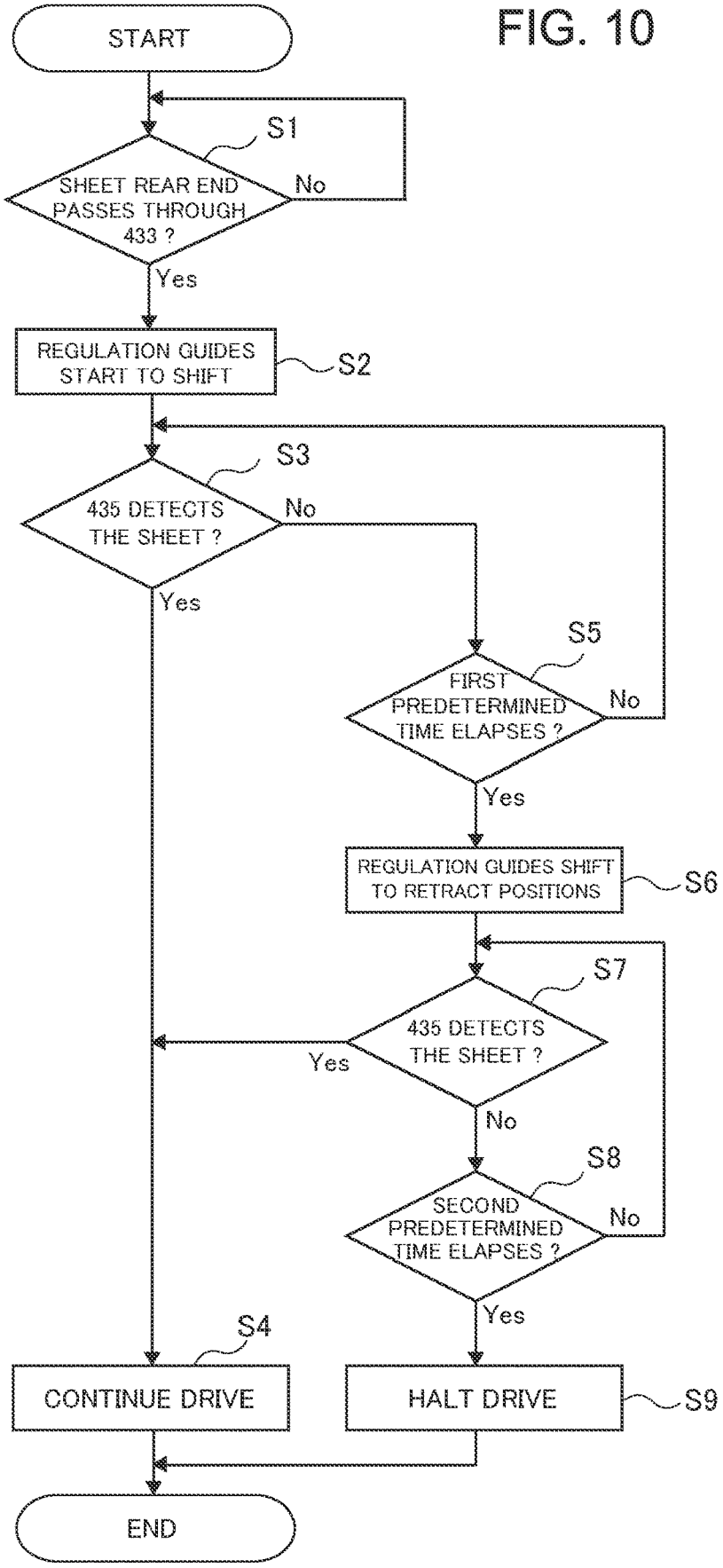
FIG. 10 is a flowchart in relation to sheet conveyance control according to the Embodiment.

This control will be described using a flowchart of FIG. 10. First, when the rear end of the sheet passes through the sheet detecting sensor 433 on the upstream side (Yes in S1), the control section 203 starts to shift the pair of regulation guides 14A, 14B from the retract positions to the guide positions (S2). Then, in the case where the sheet detecting sensor 435 on the downstream side detects the sheet (Yes in S3), the section 203 continues to drive the apparatus without any change (S4).

On the other hand, in S3, in the case where the sheet detecting sensor 435 on the downstream side does not detect the sheet (No in S3), the control section 203 determines whether or not the first predetermined time elapses since the pair of regulation guides 14A, 14B shift to the guide positions (S5). In the case where the first predetermined time does not elapse (No in S5), the flow returns to S3. When the first predetermined time elapses (Yes in S5), the pair of regulation guides 14A, 14B are shifted to the retract positions (S6). At this point, rotation of the conveyance belt 12 is continued.

Next, the control section 203 determines again whether or not the sheet detecting sensor 435 on the downstream side detects the sheet (S7). In the case where the sheet detecting sensor 435 on the downstream side detects the sheet (Yes in S7), the section 203 continues to drive the apparatus without any change (S4). On the other hand, in S7, in the case where the sheet detecting sensor 435 on the downstream side does not detect the sheet (No in S7), the control section 203 determines whether or not the second predetermined time elapses since the pair of regulation guides 14A, 14B shift to the retract positions (S8). In the case where the second predetermined time does not elapse (No in S8), the flow returns to S7. When the second predetermined time elapses (Yes in S8), the control section 203 determines that the jam of the sheet occurs, and halts all drive of the apparatus including the conveyance belt 12, and conveyance roller pairs 401, 402 and 403 (S9).

In addition, the control section 203 may control as described below. In other words, the above-mentioned retract operation may be performed, in the case where the sheet detecting sensor 435 on the downstream side does not detect the sheet after a lapse of a predetermined passing subsequent time since the rear end of the sheet passes through the sheet detecting sensor 433 on the upstream side. Essentially, irrespective of that the pair of regulation guides 14A, 14B shift to the guide positions, based on the detection result of the sheet detecting sensor 433 on the upstream side, by determining whether or not the sheet detecting sensor 435 on the downstream side detects the sheet after a lapse of the predetermined passing subsequent time since the sheet rear end passes through the sheet detecting sensor 433, the section 203 may determine whether or not to perform the retract operation. Particularly, in the case where the pair of regulation guides 14A, 14B are still positioned in the guide positions in conveying the second and subsequent sheets, in receiving the sheet in the conveyance belt 12, there is no operation for shifting the regulation guides 14A, 14B from the retract positions to the guide positions. Accordingly, in this case, it is preferable to control as described above.

Next, referring to FIGS. 11A to 11D, a specific example of operation of the pair of regulation guides 14A, 14B and conveyance belt 12 of this Embodiment will be described in the case where two sheets S1, S2 are successively conveyed to the relay conveying apparatus 400. First, as shown in FIG. 11A, in the case where the first sheet S1 is conveyed from the conveyance roller pair 401 on the upstream side to the conveyance belt 12, the control section 203 shifts the pair of regulation guides 14A, 14B to the retract positions. This is because in the case where the pair of regulation guides 14A, 14B are in the guide positions in delivering the sheet S1 to the conveyance belt 12, when the sheet S1 is skewed and/or displaced in position in the width direction Y, there is the risk that the end portion of the sheet S1 interferes with one of the regulation guides 14A, 14B, and that a conveyance failure of the sheet S1 thereby occurs.

Figure 11B:
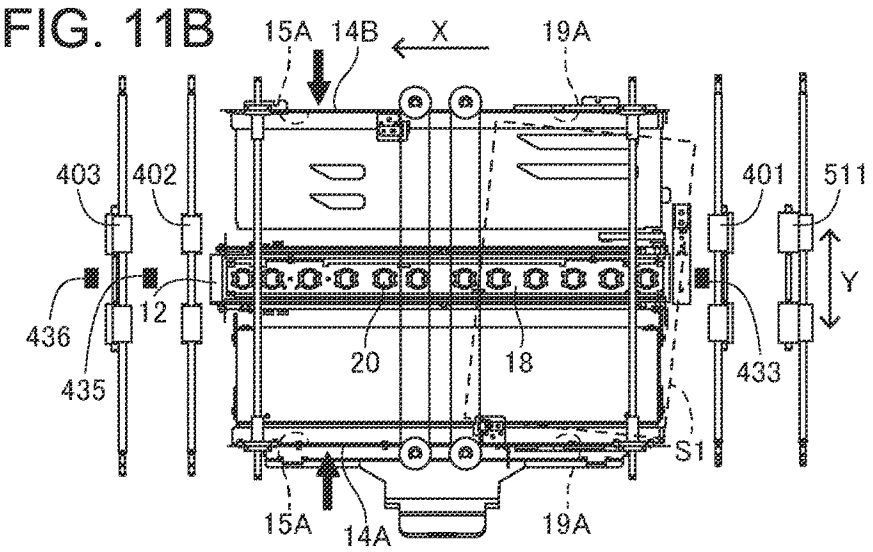
FIGS. 11A to 11D contain views to explain operation of regulation guides according to the Embodiment where
Figure 11A:
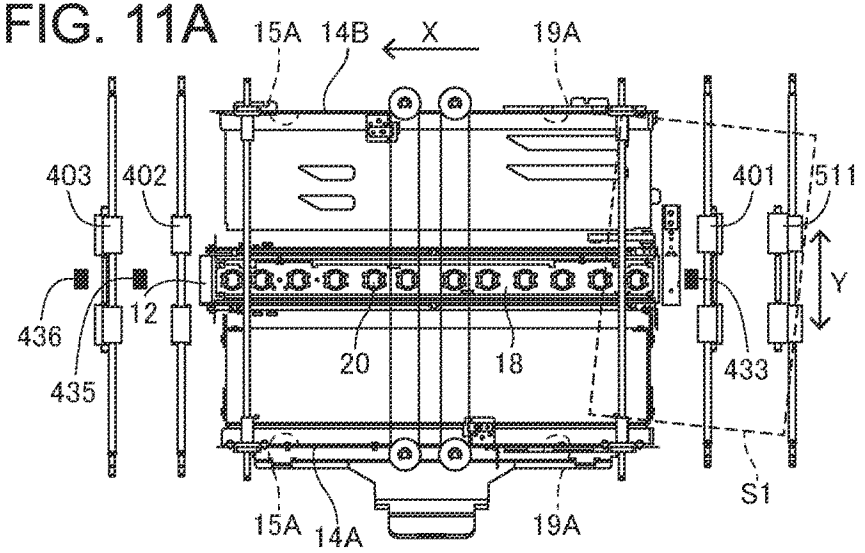

Next, as shown in FIG. 11B, after the rear end (upstream end) of the first sheet S1 delivered from the conveyance roller pair 401 to the conveyance belt 12 passes through the sheet detecting sensor 433, the control section 203 shifts the pair of regulation guides 14A, 14B from the retract positions to the guide positions. In this Embodiment, in a state in which the sheet S1 delivered to the conveyance belt 12 exists within the predetermined region A (FIG. 6B, within the predetermined region), the section 203 shifts the pair of regulation guides 14A, 14B from the retract positions to the guide positions. By this means, corrections (alignment operation) of the side registration and side skew of the sheet S1 are made.

In other words, in the case where the sheet S1 exists on the upstream side in the conveyance direction X, the regulation guides 14A, 14B are positioned in the retract positions, and the opposite end edges of the sheet S1 are separated from the guide faces 15A. Then, after the sheet S1 is further conveyed to the downstream side, and the rear end of the sheet S1 passes through the conveyance roller pair 401, the regulation guides 14A, 14B shift to the guide positions. Then, the opposite end edges of the sheet S1 in the width direction Y are brought into contact with the guide faces 15A. When the sheet S1 is struck by the guide faces 15A, while the end edges travel along the guide faces 15A, the sheet S1 slips between the conveyance belt 12 and the faces, and is conveyed in the direction parallel with the guide faces 15A. By this means, the side registration and side skew of the sheet S1 is corrected.

In this Embodiment, for a period during which the sheet is nipped and conveyed by the conveyance belt 12 and the sphere 20, the control section 203 shifts the pair of regulation guides 14A, 14B from the retract positions to the guide positions. By this means, without halting conveyance of the sheet, it is possible to make corrections of side registration, side skew and the like of the sheet, and it is possible to enhance productivity. In addition, after halting conveyance of the sheet once, the pair of regulation guides 14A, 14B may be shifted from the retract positions to the guide positions to perform alignment operation. In this case, although productivity is decreased, it is possible to make corrections of misregistration and the like with more reliability.

Figure 11D:
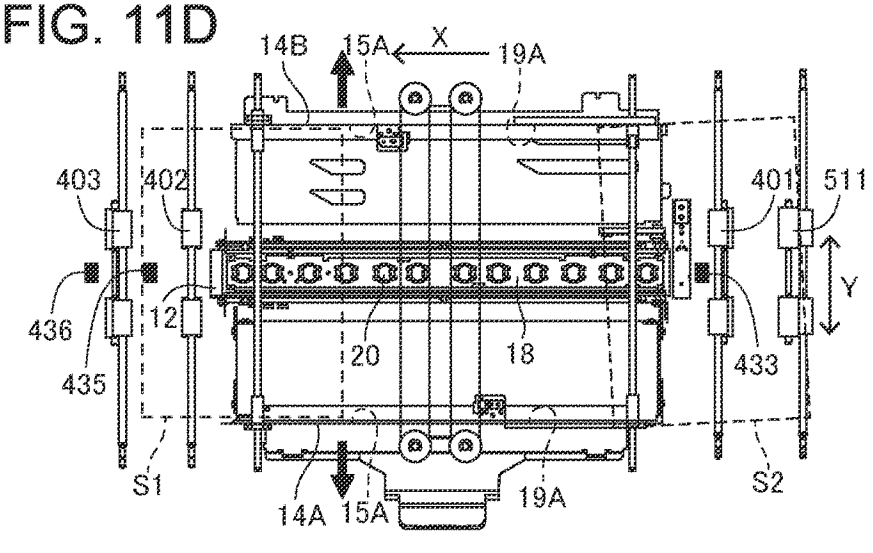
Figure 11C:
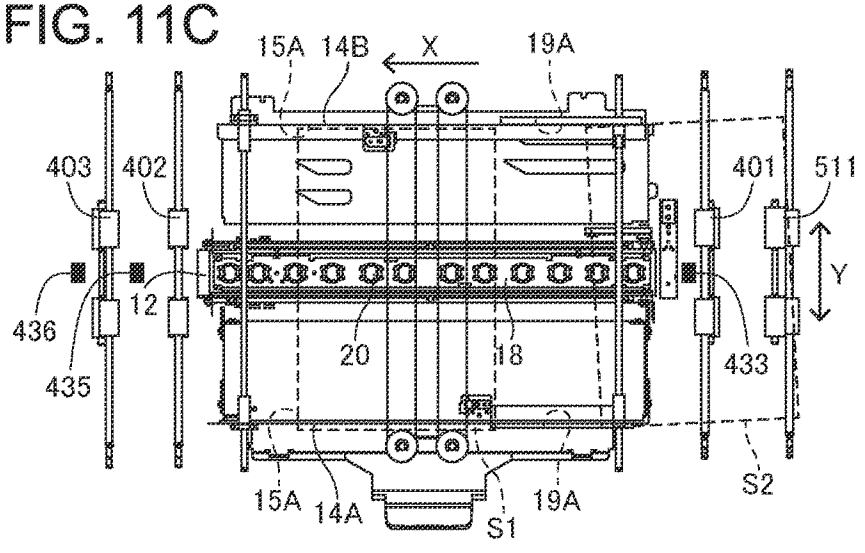

Next, as shown in FIG. 11C, a state is assumed where the sheet S1 comes into contact with at least one of the pair of regulation guides 14A, 14B to be caught, and although the conveyance belt 12 is driven, is not conveyed. In the case where the sheet detecting sensor 435 on the downstream side does not detect the sheet after a lapse of the first predetermined time since the pair of regulation guides 14A, 14B shift to the guide positions, while continuing drive of the conveyance belt 12, the control section 203 halts drive of the conveyance roller pairs 401, 511 on the upstream side.

At this point, the front end of the second sheet S2 is delivered from the conveyance roller pair 401 to the conveyance belt 12. However, since the sheet S2 is in a state of being nipped by the conveyance roller pairs 401, 511, even when the conveyance belt 12 is being driven, conveyance is halted due to drive halts of the conveyance roller pairs 401, 511. At this point, the pair of regulation guides 14A, 14B are in a state of being positioned in the guide positions, and the sheet S2 halts in a position held in the notches 19C (FIG. 6A) formed on the upstream side in the pair of regulation guides 14A, 14B. In other words, the first predetermined time is set at a time such that the subsequent sheet S2 halts inside the notches 19C of the pair of regulation guides 14A, 14B.

In other words, in this Embodiment, for a period during which the first sheet S1 is guided by the pair of regulation guides 14A, 14B, the second sheet S2 starts to move into the predetermined region A. Therefore, also in a state in which the prior sheet S1 is caught and is not conveyed, the subsequent sheet S2 enters the predetermined region A. Therefore, it is configured that the sheet S2 halts inside the notches 19C even when conveyance of the sheet S1 is halted or delayed.

As described in the above-mentioned FIGS. 6A to 6D, in the notch 19C is positioned the inner face 19A positioned on the outer side than the guide face 15A. Accordingly, also in the state in which the pair of regulation guides 14A, 14B are in the guide positions, the distance between the inner faces 19A is wider than the distance between the guide faces 15A. Therefore, even when the second sheet S2 moves into the predetermined region A, while being skewed, and/or displaced in position in the width direction Y in this state, the end portion of the sheet S2 is hard to interfere with the pair of regulation guides 14A, 14B. Therefore, in this Embodiment, even by conveying the second sheet S2 at timing as described above, a conveyance failure of the sheet is hard to occur, and it is possible to increase productivity.

On the other hand, in the case where the sheet detecting sensor 435 on the downstream side does not detect the sheet after a lapse of the first predetermined time since the pair of regulation guides 14A, 14B shift to the guide positions, while continuing drive of the conveyance belt 12, the control section 203 shifts the pair of regulation guides 14A, 14B from the guide positions to the retract positions. By this means, the sheet S1 separates from the regulation guides, and as shown in FIG. 11D, is conveyed by the conveyance belt 12. Then, when the sheet detecting sensor 435 on the downstream side detects the sheet S1, while continuing conveyance without any change, the section 203 starts to drive the conveyance roller pairs 401, 511, and resumes conveyance of the sheet S2.

In addition, in the case where the sheet detecting sensor 435 does not detect the sheet after a lapse of the second predetermined time since the pair of regulation guides 14A, 14B shift to the retract positions, the section 203 determines that the sheet jams, and halts drive of the conveyance belt 12, and other drive associated with sheet conveyance.

Thus, in the case of this Embodiment, even when the sheet delivered to the conveyance belt 12 comes into contact with one of the pair of regulation guides 14A, 14B in the guide positions and is caught, by shifting the pair of regulation guides 14A, 14B to the retract positions, it is possible to resolve the catch. Since the conveyance belt 12 is still driven, the catch-resolved sheet is conveyed downstream. By this means, without the control section 203 determining the jam, conveyance of the sheet is continued, and it is possible to suppress reductions in productivity.

In addition, there is the case where sheets with different lengths are conveyed to the relay conveying apparatus 400. Particularly, in the case of a long-length sheet, when whether or not to execute the retract operation is determined based on the detection result of the sheet detecting sensor 435 downstream side relative to the conveyance belt 12, there is the case where the retract operation is not executed although the sheet is actually caught. Therefore, in this Embodiment, in the case of conveying a long sheet such as a long-length sheet with a long length, whether or not to execute the retract operation is determined, based on the detection result of the sheet detecting sensor 436 disposed further downstream side relative to the sheet detecting sensor 435.

In other words, in the case where a length of the sheet in the conveyance direction X is a first length, the control section 203 performs the retract operation, based on the detection result of the sheet detecting sensor 435 as the first detecting section. On the other hand, in the case where a length of the sheet in the conveyance direction X is a second length longer than the first length, the control section 203 performs the retract operation, based on the detection result of the sheet detecting sensor 436 as the second detecting section. By this means, it is possible to perform the retract operation properly corresponding to the length of the sheet.

Further, in the above-mentioned description, in performing the retract operation, the pair of regulation guides 14A, 14B are shifted from the guide positions to the retract positions. In addition, a shift position from the guide position may not be the retract position in performing the retract operation. For example, the shift position may be a position between the retract position and the guide position, or may be a position retracted from the guide position farther than the retract position.

Herein, it is assumed that the above-mentioned retract position is a first retract position, and that a position to shift at the time of the retract operation is a second retract position. In this case, the guide shift section 420 is capable of shifting the pair of regulation guides 14A, 14B to the guide positions, and the first retract positions or the second retract positions retracted from the opposite end edges of the sheet in the sheet width direction Y more than the guide positions. Further, before the sheet is delivered to the conveyance belt 12, the pair of regulation guides 14A, 14B are positioned in the first retract positions. Then, in the case where the sheet detecting sensor 435 does not detect the sheet after a lapse of the first predetermined time since the pair of regulation guides 14A, 14B shift from the first retract positions to the guide positions, the control section 203 performs the retract operation for shifting the pair of regulation guides 14A, 14B from the guide positions to the second retract positions in the state of continuing to drive the conveyance belt 12 in the direction for conveying the sheet. In addition, in the case of a long sheet such as a long-length sheet, in the same manner as described above, the section 203 may perform the retract operation based on the detection result of the sheet detecting sensor 436.

Another Embodiment

In the above-mentioned Embodiment, the control section 203 for controlling the relay conveying apparatus 400 is provided in the multi-stage feed apparatus 200, and the control section 140 of the image forming apparatus 100 may perform control by the section 203. Further, the relay conveying apparatus 400 may be provided with control sections for controlling respective sections of the relay conveying apparatus 400. Furthermore, the sheet conveying apparatus is not limited to the above-mentioned relay conveying apparatus, and may be another configuration which is a sheet conveying apparatus capable of correcting misregistration of the sheet.

Further, in the above-mentioned Embodiment, the aspect is shown where after the pair of regulation guides 14A, 14B shift from the retract positions to the guide positions, when the sheet detecting sensor 435 does not detect the sheet for the first predetermined time, the pair of regulation guides 14A, 14B shift to the retract positions. In addition, a trigger for shifting the pair of regulation guides 14A, 14B from the guide positions to the retract positions may not be dependent on a detection result of the sheet detecting sensor 435, and may be dependent on a lapse of the predetermined time (first predetermined time). In other words, when the predetermined time elapses since the guides shift to the guide positions, irrespective of whether or not the sheet detecting sensor 435 detects the sheet, the pair of regulation guides 14A, 14B may be shifted from the guide positions to the retract positions.

Specifically, as in the above-mentioned Embodiment, in the state in which the pair of regulation guides 14A, 14B are positioned in the retract positions, the sheet of the conveyance belt 12 is delivered. Then, the pair of regulation guides 14A, 14B shift from the retract positions to the guide positions, while conveying the sheet using the conveyance belt 12 and the spheres 20. Next, as distinct from the above-mentioned Embodiment, after a lapse of the first predetermined time since the pair of regulation guides 14A, 14B shift to the guide positions, the retract operation is performed where the pair of regulation guides 14A, 14B shift from the guide positions to the retract positions in the state of continuing to drive the conveyance belt 12 in the direction for conveying the sheet. By this means, also in the configuration where the sheet detecting sensor 435 is omitted, conveyance of the sheet is continued, and it is possible to suppress reductions in productivity.

In addition, also in the case of performing such control, it is preferable to provide the sheet detecting sensor 435. Then, after a lapse of the first predetermined time since the pair of regulation guides 14A, 14B shift to the guide positions, in the case where the sheet is not detected by the sheet detecting sensor 435 after a lapse of the second predetermined time since the retract operation is performed where the pair of regulation guides 14A, 14B are shifted from the guide positions to the retract positions, the jam is determined, and drive of the conveyance belt is halted.

In addition, in the case where the sheet detecting sensor 435 detects the sheet before a lapse of the first predetermined time since the pair of regulation guides 14A, 14B shift to the guide positions, the retract operation may not be performed. Further, the first predetermined time and second predetermined time are similar to the foregoing, and may be the same as the example (for example, the first predetermined time is 500 ms, and for example, the second predetermined time is 100 ms) shown in the above-mentioned Embodiment, or may be set to be longer or shorter than in the example, respectively. Furthermore, as in the above-mentioned case, with respect to the shift of the pair of regulation guides 14A, 14B from the guide positions to the retract positions, and jam determination, the shift and determination may be performed by counting the drive amount of the conveyance belt 12, as a substitute for the time.

Further, in the above-mentioned Embodiment, after the rear end of the sheet passes through the sheet detecting sensor 433 on the upstream side, the pair of regulation guides 14A, 14B start to shift to the guide positions. In addition, the pair of regulation guides 14A, 14B may start to shift to the guide positions, when the rear end of the sheet comes out of the conveyance roller pair 401. For example, in the case of omitting the sheet detecting sensor 433 and/or the case capable of determining a conveyance position of the sheet by a detection result of a sensor for detecting the presence or absence of the sheet provided on the upstream side relative to the conveyance roller 401, the regulation guides 14A, 14B may start the shift at such timing.

Further, in the case where the conveyance roller pair 401 on the upstream side is the configuration capable of coming into contact and separating, the conveyance roller pair 401 may be separated before the rear end of the sheet comes out of the conveyance roller pair 401, after the front end of the sheet is delivered to the conveyance belt 12. In other words, the contact-separation mechanism (conveyance roller pair shift section) 31 described in the above-mentioned FIGS. 7, 8A and 8B is also applicable to the conveyance roller pair 401. The contact-separation mechanism 31 does not only contact and separate the conveyance roller pair, but also is capable of shifting the conveyance roller pair to the nip position for applying the conveyance force to the sheet, and the nip release position where the nip pressure is weaker than in the nip position. Accordingly, after the front end of the sheet S is delivered to the conveyance belt 12, before the rear end of the sheet S comes out of the conveyance roller pair 401, the conveyance roller pair 401 may be shifted to the nip release position with the weak nip pressure.

In this case, at timing at which the conveyance roller pair 401 is separated (at timing for shifting from the nip position to the nip release position) by the contact-separation mechanism 31, the pair of regulation guides 14A, 14B start to shift to the guide positions. Essentially, as long as the pair of regulation guides 14A, 14B are able to arrive at the guide positions after the sheet loses contact with the conveyance roller pair 401, it is possible to configure the timing of shift starts of the pair of regulation guides 14A, 14B as appropriate. In addition, the nip release state corresponds to a state where the conveyance roller pair is separated, and a state where the conveyance roller pair mutually comes into contact but the nip pressure is lower than in conveying the sheet.

In addition, this application claims priority from Japanese Patent Application No. 2020-112402 and Japanese Patent Application No. 2021-097981 incorporated herein by reference.

The invention claimed is:

1. A sheet conveying apparatus which receives and conveys a sheet conveyed by a conveyance member for conveying the sheet in a predetermined conveyance direction, comprising:

an endless conveyance belt disposed on a downstream side relative to the conveyance member in the conveyance direction and including a conveyance face extended in the conveyance direction, the conveyance belt conveying the sheet delivered to the conveyance face in the conveyance direction;

a plurality of spheres disposed in positions opposed to the conveyance face in the conveyance direction to be rotatable in any direction, while nipping the sheet between the spheres and the conveyance face;

a pair of regulation guides disposed on opposite sides relative to the conveyance belt with respect to a sheet width direction crossing the conveyance direction to be able to guide opposite end edges in the sheet width direction of the sheet conveyed by the conveyance belt and the spheres, while being nipped;

a guide shift section capable of shifting the pair of regulation guides to guide positions for guiding the opposite end edges of the sheet in the sheet width direction and retract positions retracted from the opposite end edges of the sheet in the sheet width direction more than the guide positions; and a detecting section disposed on a downstream side relative to the conveyance belt in the conveyance direction to detect presence or absence of the sheet, wherein when the detecting section does not detect the sheet after a lapse of a predetermined time since the pair of regulation guides shifts from the retraction positons to the guide positions, a retract operation is performed where the pair of regulation guides shifts from the guide positions toward the retract positions in a state of continuing to drive the conveyance belt in the conveying direction for conveying the sheet.

2. The sheet conveying apparatus according to claim 1, wherein the predetermined time is a first predetermined time, and when the detecting section does not detect the sheet after a lapse of a second predetermined time since the retract operation is performed, drive of the conveyance belt is halted.

3. The sheet conveying apparatus according to claim 1, wherein the detecting section is a first detecting section, the apparatus is further provided with a second detecting section disposed on a downstream side relative to the first detecting section in the conveyance direction to detect presence or absence of the sheet, and when a length of the sheet in the conveyance direction is a first length, the retract operation is performed based on a detection result of the first detecting section, while when the length of the sheet in the conveyance direction is a second length longer than the first length, the retract operation is performed based on a detection result of the second detecting section.

4. The sheet conveying apparatus according to claim 1, further comprising:

an upstream-side detecting section disposed on an upstream side relative to the conveyance belt in the conveyance direction to detect presence or absence of the sheet, wherein when a rear end of the sheet passes through the upstream-side detecting section, the guide shift section starts to shift the pair of regulation guides from the retract positions toward the guide positions.

5. An image forming system comprising:

a sheet conveying apparatus; and an image forming apparatus including an image forming section capable of forming an image on the sheet conveyed by the sheet conveying apparatus, wherein the sheet conveying apparatus is the sheet conveying apparatus according to claim 1.

6. A sheet conveying apparatus which receives and conveys a sheet conveyed by a conveyance member for conveying the sheet in a predetermined conveyance direction, comprising:

an endless conveyance belt disposed on a downstream side relative to the conveyance member in the conveyance direction and including a conveyance face extended in the conveyance direction, the conveying belt conveying the sheet delivered to the conveyance face in the conveyance direction;

a plurality of spheres disposed in positions opposed to the conveyance face in the conveyance direction to be rotatable in any direction, while nipping the sheet between the spheres and the conveyance face;

a pair of regulation guides disposed on opposite sides relative to the conveyance belt with respect to a sheet width direction crossing the conveyance direction to be able to guide opposite end edges in the sheet width direction of the sheet conveyed by the conveyance belt and the spheres, while being nipped;

a guide shift section capable of shifting the pair of regulation guides to guide positions for guiding the opposite end edges of the sheet in the sheet width direction and retract positions retracted from the opposite end edges of the sheet in the sheet width direction more than the guide positions;

an upstream-side detecting section disposed on an upstream side relative to the conveyance belt in the conveyance direction to detect presence or absence of the sheet; and a downstream-side detecting section disposed on a downstream side relative to the conveyance belt in the conveyance direction to detect presence or absence of the sheet, wherein after a rear end of the sheet passes through the upstream-side detecting section, the guide shift section starts to shift the pair of regulation guides from the retract positions to the guide positions, and when the downstream-side detecting section does not detect the sheet after a lapse of a predetermined time since the rear end of the sheet passes through the upstream-side detecting section, a retract operation is performed where the pair of regulation guides shifts from the guide positions toward the retract positions in a state of continuing to drive the conveyance belt in the conveying direction for conveying the sheet.

7. An image forming system comprising:

a sheet conveying apparatus; and an image forming apparatus including an image forming section capable of forming an image on the sheet conveyed by the sheet conveying apparatus, wherein the sheet conveying apparatus is the sheet conveying apparatus according to claim 6.

8. A sheet conveying apparatus which receives and conveys a sheet conveyed by a conveyance member for conveying the sheet in a predetermined conveyance direction, comprising:

an endless conveyance belt disposed on a downstream side relative to the conveyance member in the conveyance direction and including a conveyance face extended in the conveyance direction, the conveyance belt conveying the sheet delivered to the conveyance face in the conveyance direction;

a plurality of spheres disposed in positions opposed to the conveyance face in the conveyance direction to be rotatable in any direction, while nipping the sheet between the spheres and the conveyance face;

a pair of regulation guides disposed on opposite sides relative to the conveyance belt with respect to a sheet width direction crossing the conveyance direction to be able to guide opposite end edges in the sheet width direction of the sheet conveyed by the conveyance belt and the spheres, while being nipped;

a guide shift section capable of shifting the pair of regulation guides to guide positions for guiding the opposite end edges of the sheet in the sheet width direction, and first retract positions or second retraction positions retracted from the opposite end edges of the sheet in the sheet width direction more than the guide positions; and a detecting section disposed on a downstream side relative to the conveyance belt in the conveyance direction to detect presence or absence of the sheet, wherein the pair of regulation guides is positioned in the first retract positions before the sheet is delivered to the conveyance belt, and when the detecting section does not detect the sheet after a lapse of a predetermined time since the pair of regulation guides shifts from the first retraction positons to the guide positions, a retract operation is performed where the pair of regulation guides shifts from the guide positions toward the second retract positions in a state of continuing to drive the conveyance belt in the conveying direction for conveying the sheet.

9. An image forming system comprising:

a sheet conveying apparatus; and an image forming apparatus including an image forming section capable of forming an image on the sheet conveyed by the sheet conveying apparatus, wherein the sheet conveying apparatus is the sheet conveying apparatus according to claim 8.

10. A sheet conveying apparatus which receives and conveys a sheet conveyed by a conveyance member for conveying the sheet in a predetermined conveyance direction, comprising:

an endless conveyance belt disposed on a downstream side relative to the conveyance member in the conveyance direction and including a conveyance face extended in the conveyance direction, the conveyance belt conveying the sheet delivered to the conveyance face in the conveyance direction;

a plurality of spheres disposed in positions opposed to the conveyance face in the conveyance direction to be rotatable in any direction, while nipping the sheet between the spheres and the conveyance face;

a pair of regulation guides disposed on opposite sides relative to the conveyance belt with respect to a sheet width direction crossing the conveyance direction to be able to guide opposite end edges in the sheet width direction of the sheet conveyed by the conveyance belt and the spheres, while being nipped;

a guide shift section capable of shifting the pair of regulation guides to guide positions for guiding the opposite end edges of the sheet in the sheet width direction and retract positions retracted from the opposite end edges of the sheet in the sheet width direction more than the guide positions; and a detecting section disposed on a downstream side relative to the conveyance belt in the conveyance direction to detect presence or absence of the sheet, wherein when the detecting section does not detect the sheet in continuing drive of the conveyance belt in the conveyance direction by a predetermined time after the pair of regulation guides shifts from the retraction positons to the guide positions, a retract operation is performed where the pair of regulation guides shifts from the guide positions toward the retract positions in a state of continuing to drive the conveyance belt in the conveying direction for conveying the sheet.

11. An image forming system comprising:

a sheet conveying apparatus; and an image forming apparatus including an image forming section capable of forming an image on the sheet conveyed by the sheet conveying apparatus, wherein the sheet conveying apparatus is the sheet conveying apparatus according to claim 10.

12. A sheet conveying apparatus which receives and conveys a sheet conveyed by a conveyance member for conveying the sheet in a predetermined conveyance direction, comprising:

an endless conveyance belt disposed on a downstream side relative to the conveyance member in the conveyance direction and including a conveyance face extended in the conveyance direction, the conveyance belt conveying the sheet delivered to the conveyance face in the conveyance direction;

a plurality of spheres disposed in positions opposed to the conveyance face in the conveyance direction to be rotatable in any direction, while nipping the sheet between the spheres and the conveyance face;

a pair of regulation guides disposed on opposite sides relative to the conveyance belt with respect to a sheet width direction crossing the conveyance direction to be able to guide opposite end edges in the sheet width direction of the sheet conveyed by the conveyance belt and the spheres, while being nipped; and a guide shift section capable of shifting the pair of regulation guides to guide positions for guiding the opposite end edges of the sheet in the sheet width direction and retract positions retracted from the opposite end edges of the sheet in the sheet width direction more than the guide positions, wherein the pair of regulation guides is shifted from the retract positions to the guide positions, while conveying the sheet in the conveyance direction using the conveyance belt and the spheres, and after a lapse of a predetermined time since the pair of regulation guides shifts to the guide positions, a retract operation is performed where the pair of regulation guides shifts from the guide positions toward the retract positions in a state of continuing to drive the conveyance belt in the conveying direction for conveying the sheet.

13. The sheet conveying apparatus according to claim 12, further comprising:

a detecting section disposed on the downstream side relative to the conveyance belt in the conveyance direction to detect presence or absence of the sheet, wherein the predetermine time is a first predetermined time, and when the detecting section does not detect the sheet after a lapse of a second predetermined time since the retract operation is performed, drive of the conveyance belt is halted.

14. An image forming system comprising:

a sheet conveying apparatus; and an image forming apparatus including an image forming section capable of forming an image on the sheet conveyed by the sheet conveying apparatus, wherein the sheet conveying apparatus is the sheet conveying apparatus according to claim 12.

* * * * *